US005564254A

United States Patent [19]

Thimon et al.

[11] Patent Number: 5,564,254

[45] Date of Patent: Oct. 15, 1996

[54] METHOD, A MACHINE AND AN INSTALLATION FOR PACKAGING A LOAD PROVIDED WITH AT LEAST ONE EDGE-PROTECTING ANGLE STRIP; APPARATUS FOR GRASPING, DISPLACING, DEPOSITIONING AND HOLDING SUCH AN ANGLE STRIP

[75] Inventors: Jacques Thimon, Annecy, France; Jack Morantz, Westmount, Canada

[73] Assignee: Newtec International, S.A., Aix-Les-Bains, France

[21] Appl. No.: 383,690

[22] Filed: Feb. 1, 1995

Related U.S. Application Data

[63] Continuation of Ser. No. 863,287, Jul. 16, 1993, abandoned, and Ser. No. 863,283, filed as PCT/FR91/00869, Nov. 7,1991 published as WO92/08644, May 29, 1992, abandoned.

[30] Foreign Application Priority Data

Nov. 9, 1990 [FR] France ..... 90 13928

[51] Int. Cl.[6] ..... B65B 61/00

[52] U.S. Cl. ..... 53/410; 53/139.7; 53/465; 53/139.6; 53/210; 53/397; 53/580

[58] Field of Search ..... 53/139.6, 139.7, 53/170, 176, 210, 211, 212, 214, 397, 399, 410, 449, 465, 466, 556, 580, 582, 587, 588, 589

[56] References Cited

U.S. PATENT DOCUMENTS

| | | | |
|---|---|---|---|
| 2,291,645 | 8/1942 | Nordquist | 53/466 X |
| 2,801,507 | 8/1957 | Claus et al. | 53/589 X |
| 2,937,484 | 5/1960 | Wiman | 53/580 X |
| 3,003,296 | 10/1961 | Feldkamp et al. | 53/176 |
| 3,095,678 | 7/1963 | Cliff et al. | 53/139.7 X |
| 3,241,287 | 3/1966 | Chundelak | 53/139.6 |
| 3,271,925 | 9/1966 | Aubery | 53/589 X |
| 3,378,987 | 4/1968 | Lems | 53/589 X |
| 3,585,780 | 6/1971 | Elmore | 53/589 X |
| 3,621,638 | 11/1971 | Grocke | 53/556 X |
| 3,735,555 | 5/1973 | Pasic | 53/582 X |
| 3,893,279 | 7/1975 | Bostrom | 53/176 X |
| 4,244,471 | 1/1981 | Plante | 53/441 X |
| 4,409,776 | 10/1983 | Usui | 53/399 |
| 4,413,463 | 11/1983 | Lancaster | 53/399 |
| 4,450,668 | 5/1984 | Grossi | 53/176 |

(List continued on next page.)

FOREIGN PATENT DOCUMENTS

| | | | |
|---|---|---|---|
| 0060543 | 12/1982 | European Pat. Off. . | |
| 177413 | 4/1986 | European Pat. Off. . | |
| 180517 | 5/1986 | European Pat. Off. . | |
| 184485 | 6/1986 | European Pat. Off. . | |
| 0853775 | 9/1985 | Finland . | |
| 2228669 | 12/1974 | France . | |
| 2243113 | 4/1975 | France . | |
| 2281275 | 3/1976 | France . | |
| 2413270 | 7/1979 | France . | |
| 2470056 | 5/1981 | France . | |
| 2468506 | 5/1981 | France . | |
| 2540828 | 8/1984 | France . | |
| 2431153 | 1/1976 | Germany . | |
| 52-49195 | 4/1977 | Japan | 53/139.7 |
| 52-70693 | 6/1977 | Japan | 53/139.7 |
| 1279030 | 11/1989 | Japan | 53/139.7 |

*Primary Examiner*—John Sipos
*Assistant Examiner*—Daniel Moon
*Attorney, Agent, or Firm*—Schwartz & Weinrieb

[57] ABSTRACT

A method of packaging a load that is generally prismatic in shape in which at least one rigid protective angle strip is initially placed on at least one edge of the load. The strip is then rigidly and permanently secured to the load. An apparatus is used for grasping, displacing, depositing, and holding the protective angle strip. A protective angle strip is taken from a magazine to an edge of the load by using the apparatus, wherein the protective angle strip is held temporarily while the angle strip is simultaneously secured rigidly to the load, and once it has been rigidly secured, the apparatus is disengaged from the angle strip.

40 Claims, 16 Drawing Sheets

U.S. PATENT DOCUMENTS

| | | | |
|---|---|---|---|
| 4,473,990 | 10/1984 | Thimon | 53/567 |
| 4,587,791 | 5/1986 | Brouse et al. . | |
| 4,587,796 | 5/1986 | Haloila | 53/588 |
| 4,607,476 | 8/1986 | Fulton | 53/556 X |
| 4,671,046 | 6/1987 | Lewis et al. . | |
| 4,679,376 | 7/1987 | Ekblom | 53/211 X |
| 4,700,530 | 10/1987 | Norberg | 53/582 X |
| 4,722,170 | 2/1988 | Ball et al. | 53/556 |
| 4,744,198 | 5/1988 | Hood et al. | 53/211 X |
| 4,756,138 | 7/1988 | Karpisek | 53/397 |
| 4,897,980 | 2/1990 | Geyser et al. | 53/128 |
| 4,936,080 | 6/1990 | Haloila | 53/176 X |
| 4,949,533 | 8/1990 | Bate | 53/556 |
| 4,998,619 | 3/1991 | Sowa et al. | 206/392 |
| 5,226,280 | 7/1993 | Scherer et al. | 53/139.7 |
| 5,289,668 | 3/1994 | Meyer | 53/139.7 X |

FIG.12
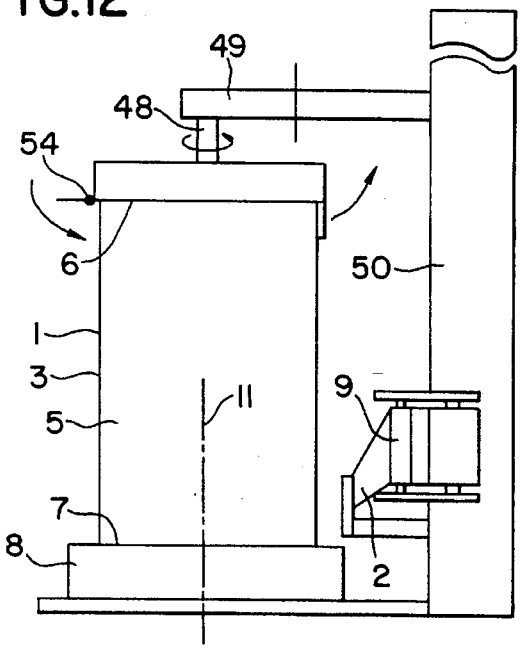
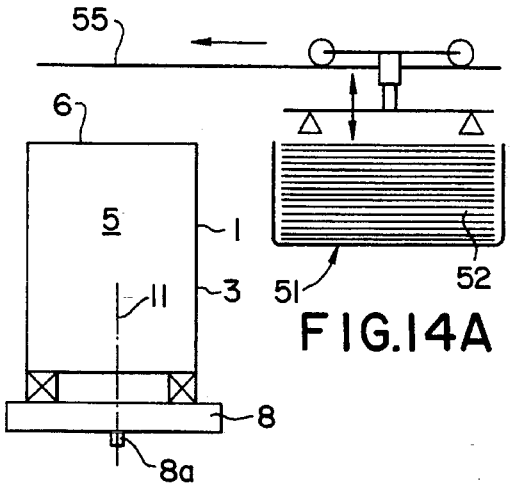
FIG.14A
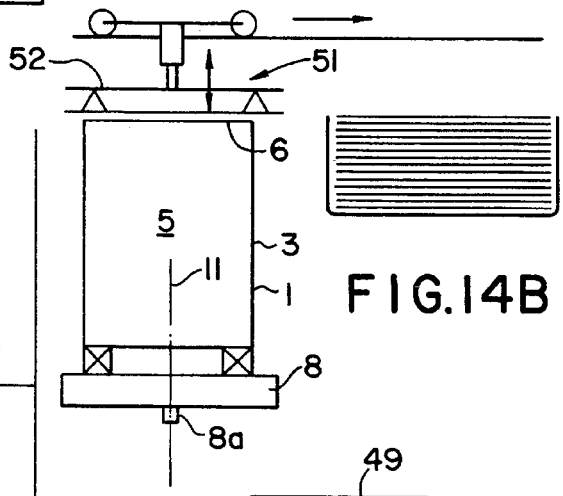
FIG.14B
FIG.13
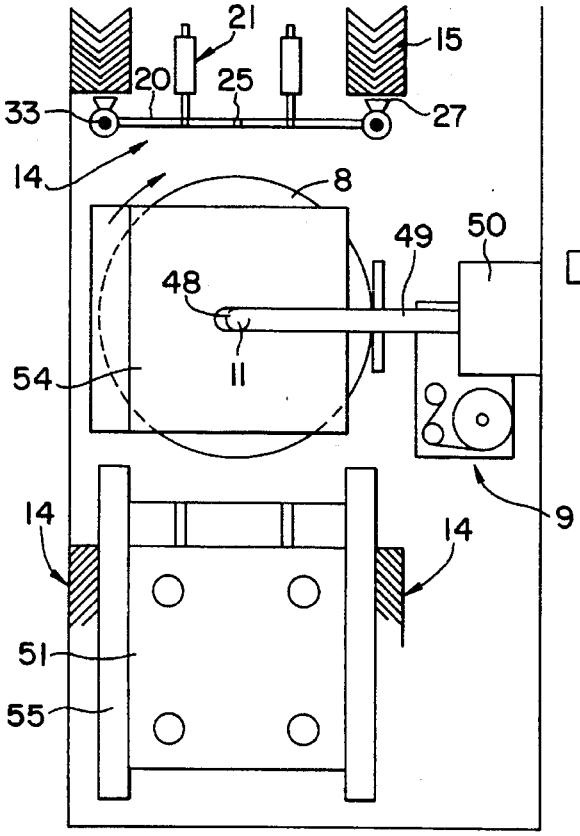
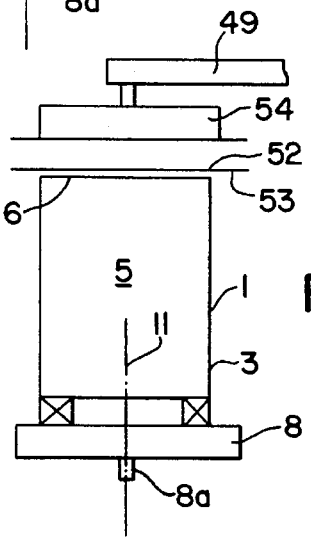
FIG.14C

METHOD, A MACHINE AND AN INSTALLATION FOR PACKAGING A LOAD PROVIDED WITH AT LEAST ONE EDGE-PROTECTING ANGLE STRIP; APPARATUS FOR GRASPING, DISPLACING, DEPOSITIONING AND HOLDING SUCH AN ANGLE STRIP

This is a continuation of application Ser. No. 863,287, filed Jul. 16, 1993, now abandoned, which is related to, should be cross-referenced with and is a continuation of Ser. No. 863,283, filed on Jun. 24, 1992, now abandoned, and which is a National Stage Application of international application Ser. No. PCT/FR91/00869, filed 7 Nov. 1991, which in turn is based upon French priority application 90/13928, filed 9 Nov. 1990.

FIELD OF THE INVENTION

The invention relates to a method, a machine, and an installation for packaging a load provided with at least one edge-protecting angle strip, and to apparatus for grasping, displacing, depositing, and holding such an angle strip.

The invention is more particularly applicable to a palletized load including four protective angle strips whose longitudinal direction is generally vertical and which are applied to the four vertical edges of the load between the four vertical lateral faces thereof. Such protective angle strips, in particular made of folded cardboard, are intended to provided local padding that ensures better protection for the vertical edges of the load. When such a palletized load is to be covered with packaging film, the angle strips prevent the edges, if they are sharp, from piercing or splitting or breaking the packaging film.

BACKGROUND OF THE INVENTION

Until now, when such protective angle strips have been provided, they have been handled essentially manually. Once put into place on the vertical edges of the load they are held there by binding or by some other similar means. That technology suffers not only from the drawback inherent to all manual handling (cost, low throughput, or the like), but any mechanization runs into a problem of interference with the moving members used for and during packaging. Such problems have had the effect of limiting the use of such angle strips, even though they present many advantages for palletized loads contained in outer packaging that applies large compression forces. A mechanization technique has been proposed (see Document EP-A-0 060 543), but it applies essentially to the top horizontal edges and not to vertical edges. In addition, that technique considerably slows down throughput. Reference may also be made to the following documents: DE-A-2 431 153, U.S. Pat. No. 4,587,791, FR-A-2 540 828, and U.S. Pat. No. 4,671,046.

The state of the art concerning known methods and machines for applying outer packaging to palletized loads includes the following documents in particular: FR-A-2 468 506, FR-A-2 470 056, U.S. Pat. No. 4,587,796, FR-A-2 228 669, FR-A-2 243 113, FR-A-2 413 270, FR-A-2 281 275, U.S. Pat. No. 4,473,990, EP-A-0 184 485, EP-A-0 177 413, EP-A-0 180 517, and U.S. Pat. No. 4,587,796. In general, those methods and machines are well known to the person skilled in the art, and the techniques implemented may be the following: the "curtain" technique, straight or helical winding over the full width or using bands, or applying a tube covering. In the "curtain" technique, a curtain of outer packaging film is set up between two vertical axis film reels; then the load is caused to advance horizontally towards the curtain of film which is deformed into a U-shape; after which the curtain is closed and fastened together. In the winding technique, relative pivoting is established about a vertical axis between the load and a reel of film in strip form. This winding technique includes several different variants: the load may remain stationary and the reel of film may be rotated around the load (a stationary load and rotating reel machine); the load may be rotated, with the axis of the reel of film in strip form remaining in a fixed position (a turntable machine). The width of the strip of film may be the same as the height of the load or it may be a fraction thereof. The winding may be straight or helical. The winding technique is also applicable to a load that extends horizontally and that is subjected to relative displacement along its axis. The reel of film in strip form then has a horizontal axis. In the technique using a tube covering, a flattened tube of film is wound onto a reel. The tube is withdrawn from the reel and is opened and stretched so as to be fitted over the load by sliding vertically downwards, using means such as fingers, clamps, a supporting frame, belts, chains, and the like. These techniques make use of film that may be perforated like a net, or that may be unperforated. The film is a heat-shrink film or a stretch film. If it is a stretch film it may be stretched or it may be pre-stretched. The entire load or only a portion thereof may be covered by the film. These techniques may be varied, in particular as follows: a top or bottom sheet or endplate or frame may be placed on the top or bottom horizontal face of the load (for example, between the pallet and the load). The outer packaging film may comprise a plurality of layers. The pallet may be replaced by a false pallet. An outer packaging machine may be integrated into an installation which includes a palletizing machine upstream.

OBJECTS OF THE INVENTION

An object of the invention is thus to make it possible to mechanize and automate the placement of such protective angle strips on loads to be packaged.

Another object is to make such placement possible while avoiding any collision with the moving members of the machine used for outer packaging.

Another object is to make it possible in some cases to avoid the need to install binding or other similar means specifically for the purpose of holding the angle strip(s) before the outer packaging holds it (or them) captive.

Another object is to enable angle strips of different formats to be placed on loads of different formats.

Another object is to provide a method and a machine for applying outer packaging to loads and capable of putting such angle strips into place.

Another object is to provide apparatus specially designed for grasping, displacing, depositing, and holding such angle strips (while they are being put into place).

Another object is to propose a machine and an installation for applying packaging or outer packaging to loads, in particular palletized loads, and including one or more of such types of apparatuses.

Another object is to provide a load, in particular a palletized load with angle strips, obtained by said method or using said machine.

SUMMARY OF THE INVENTION

These objects and others are achieved by means of a method of packaging a load that is generally prismatic in shape and more particularly in the form of a rectangular block, in which at least one rigid protective angle strip is initially placed on at least one edge of the load, and is then rigidly and permanently secured to the load, and in which apparatus is used for grasping, displacing, depositing, and holding a protective angle strip, which apparatus is located between a magazine for protective angle strips and the edge of the load to be fitted with an angle strip; a protective angle strip is taken from the magazine to an edge of the load by using said apparatus; and by using said apparatus only, the protective angle strip brought to and deposited on the edge of the load is held temporarily in at least a first zone thereof while the angle strip is simultaneously secured rigidly to the load, and once it has been rigidly secured thereto, said apparatus is disengaged from the angle strip.

In a first variant implementation, the angle strip, held in place by the apparatus, and some of the faces of the load or a packaging element thereof are surrounded with at least one wrapping strip applied to the load and located in at least a second zone different from the first zone so that the wrapping strip secures the angle strip. The wrapping strip is either a hoop strip or a wider strip. It is specifically intended to hold the angle strip and it may also constitute packaging (or outer packaging) for the load.

In a second variant implementation, the angle strip is glued, welded, stapled, clipped, or bonded to the load or to a packaging element thereof for the purpose of securing the angle strip. The packaging element of the load to which the angle strip is rigidly associated is selected from the group comprising: the pallet, an intermediate plate, an endplate or frame, and a container of the load itself.

In a third variant implementation, the angle strip is clamped at at least one of its ends, to the load in a zone that is at a distance from the first zone, by means of an endplate or frame having a margin folded down over the angle strip, thereby clamping it, and to this end: the angle strip is applied to the edge and an endplate or frame having a margin that is not folded down is applied to at least one of the end faces of the load; after which the margin of the endplate or frame is positively folded down onto the angle strip.

Whichever variant implementation is used, it is also possible for at least some of the faces of the load and the held-in place angle strip to be at least partially covered with wrapping film applied to the load, to the angle strip and to any members that may be holding the angle strip, a wrapping strip, glue, staples, clips, bonding, or a folded-down margin of an endplate or frame.

As can be seen from the above, the packaging film used is either intended essentially for providing the outer packaging of the load, with the angle strip being held by other means, or else it contributes substantially to holding the angle strip.

The objects of the invention are also achieved by means of apparatus for grasping, displacing, depositing, and holding a protective angle strip on the edge of a load, the apparatus comprising:

a chassis;

an angle strip magazine organized so that the angle strips are stored therein with their outside angles directed towards the outlet opening of the magazine;

a support arm carried by the chassis and mounted thereon to move between two extreme positions: a grasping position and a common position both for depositing and for holding, at which positions the arm is respectively close to the outlet opening of the magazine, or else is distant therefrom and close to an edge of the load;

first drive means acting on the arm to drive it between and to lock it at its two extreme positions;

means for grasping and holding an angle strip essentially by its outside angle, said means being carried by the support arm and occupying either an active state or an inactive state;

specific control means for the grasping and holding means enabling them to pass between said two states and enabling them to be temporarily maintained in one or the other of the two states; and overall control means for coordinating the first drive means and the specific control means.

These objects are also achieved by means of a packaging machine suitable for rigidly and permanently associating one or more angle strips on a load, the machine including at least one such apparatus for grasping, displacing, depositing, and holding an angle strip, and at least one apparatus for rigidly and permanently associating an angle strip deposited on the load by said apparatus, to the load itself or else to an element of the packaging thereof.

The apparatus for providing such rigid association is selected from the group comprising: apparatus for gluing, welding, stapling, clipping, or bonding the angle strip on the load or on a packaging element thereof; apparatus for folding down the margin of an endplate or frame, thereby clamping the angle strip; and a machine for providing outer packaging of the palletized load in which the outer packaging film provides at least the function of securing the angle strip.

The packaging machine thus enabling the load and an angle strip to be rigidly associated with each other may have associated therewith and functionally downstream therefrom an outer packaging machine having the essential function of providing outer packaging for the load and which is selected from the group comprising: curtain machines; winding machines; and tube covering machines.

The two outer packaging machines provided for holding the angle strip in place and for applying outer packaging to the load may be separate, but they are preferably common, with the same machine performing both functions.

Such outer packaging machines may therefore be selected from the group comprising: curtain machines; winding machines; and tube covering machines.

According to another feature, the packaging machine enabling the load to be rigidly associated with an angle strip may itself be functionally associated with at least one apparatus for feeding and depositing an endplate or frame having a folding margin or flap.

As can be seen from the above, the invention can implement an outer packaging machine having the following functions: installing outer packaging on a load that has previously been provided with at least one angle strip that is rigidly and permanently associated therewith; participating substantially in rigidly and permanently holding the angle strip; or performing both functions simultaneously. When the machine contributes to rigidly and permanently holding the angle strip, the objects of the invention are also achieved by such an outer packaging machine comprising:

support means for supporting the load;

feed means for feeding the packaging film;

moving means to enable a load carried by the support means to be covered with the film coming from the feed means; and at least one above-defined apparatus for grasping, displacing, depositing, and holding a protective angle strip.

According to other, non-limiting features of the method, while a protective angle strip is being transported from the magazine to the corresponding edge of the load by means of said apparatus, the same apparatus also causes the strip to pivot through about 180° about its general longitudinal direction. The load and the angle strip may be covered by wrapping the same with an outer packaging film in strip form taken from a reel of such film, the film itself sufficing substantially to hold the angle strip and simultaneously provide outer packaging for the load, or else serving essentially only for outer packaging purposes. To this end, the following steps are performed in succession: an initial free end portion of the wrapping strip is associated with the load, or with an element of its packaging, or with an angle strip, or with a member for holding it; relative displacement is imparted between the load and the reel of film so as to cause the axis of the reel of film to rotate around the wrapping axis of the load; said strip of film is cut transversely once wrapping has been completed; and the free end portion of the strip of film is associated with the wound film, or with the load, or with an element of the packaging thereof, or with an angle strip, or with a member for holding it. It is possible to use pre-stretched stretch film.

In a first variant, preformed angle strips are used, they are grasped, displaced, put into place, and held while substantially in said preformed state. In a second variant, flat angle strips are used, they are grasped and transformed in said flat state, and they are given the desired shape by being deformed in situ on the corresponding edge of the load.

According to other non-limiting features of the apparatus for grasping, displacing, depositing, and holding an angle strip, a first end portion of a support arm is pivotally mounted on the chassis about a hinge axis that is substantially parallel to the general longitudinal direction of the outlet opening from the magazine, and the second end portion of the arm supports the grasping and holding means. The first drive means (which may comprise an actuator) serves to pivot the support arm between its two extreme positions that are angularly separated by a fraction of a turn, in particular about one-eighth of a turn. The grasping and holding means comprises at least one suction cup which, when the support arm is in its grasping position, is situated substantially in the outlet opening of the magazine, together with at least one shaping member which is generally in the shape of an angle strip. The grasping and holding means are displaceably mounted on the support arm so as to move between two extreme relative positions, namely a grasping position and a placing position. Second drive means for the grasping and holding means serve to displace such grasping and holding means between their two extreme positions and to look such grasping and holding means in either position. The overall control means ensures the fact that the second drive means is coordinated with the first drive means and with the specific control means. The apparatus also includes means suitable firstly for ensuring that there is always an angle strip in the outlet opening of the magazine regardless of the extent to which the magazine is filled, and secondly for exerting a force at least on the angle strip in said opening, which force tends to prevent it from moving back into the magazine, that is, it tends to hold the strip in the opening of the magazine so as to be ready for use. The chassis of the apparatus, the grasping and holding means, and/or the support arm are mounted to be displaceable or to have an adjustable stroke so as to enable the apparatus to be adapted to loads of different sizes.

According to other non-limiting features of the outer packaging machine used for holding the angle strip and, where applicable, for providing outer packaging to the load per se, said machine is preferably of the winding machine type having a vertical axis or a horizontal axis. For use with a plurality of edges on the load to be protected, the machine may include a corresponding plurality of substantially similar apparatus for grasping, displacing, depositing, and holding angle strips. The general longitudinal directions of the magazines for such apparatus are parallel to one another. Their support arms lie in a common plane. The apparatuses are substantially uniformly distributed around a zone in which the load is placed. In a particular embodiment, the load-supporting means comprises a support plate having a substantially vertical axis; the moving means for enabling a load to be covered with film comprises means for causing relative pivoting of the plate about its axis relative to the film feed means; and an apparatus for grasping, displacing, depositing, and holding an angle strip may include a magazine whose general longitudinal direction is vertical, with its bottom edge being substantially coplanar with the plate.

In a particular embodiment of the winding machine, its support plate is stationary and the feeding and covering means for feeding packaging film and for covering the load comprises a ring that is substantially coaxial with the table, that supports a reel of film, and that is mounted to slide vertically along said axis between a bottom position close to the plane of the plate and a top position distant therefrom, thereby enabling the axis of the reel of film to rotate around the load. The feeding and covering means may include equivalent means for supporting the reel of film to provide the same path for the reel of film. In either case the apparatus for grasping, displacing, depositing, and holding the angle strip are essentially placed outside and close to the ring and its path.

In another non-limiting particular embodiment, the support plate is a turntable that rotates about its own axis and the reel of film in strip form for winding purposes has an axis whose position is fixed. Under such circumstances, the machine may include apparatus for folding down the margin of an end-plate or frame placed on the top horizontal face of the load and rotating synchronously with the turntable, at least initially when the vertical angle strip still needs to be held since the outer packaging film has yet to be put into place.

According to other features, the invention also relates to apparatus for feeding and depositing an endplate or frame, and also to apparatus for folding down the flap of such an endplate or frame and which is suitable for being incorporated in such a packaging machine.

Such feeding and depositing apparatus comprises:

a chassis;

at least one magazine for housing endplates or frames;

grasping means for grasping an endplate or frame and having an active state and an inactive state;

support means for supporting the grasping means;

drive means for driving the support means between a grasping position in which the grasping means is situated at or in the vicinity of the outlet opening of the magazine, and a depositing position in which the grasping means is situated at or in the vicinity of the zone where the endplate or frame is to be deposited on the load; and control means coordinating the operation of the grasping means and of the drive means.

Such apparatus for folding down the flap comprises:

a chassis;

at least one flap displacement member carried by the chassis in a movable manner between an inactive position in which the flap can be placed substantially coplanar with the endplate or frame, and an active position in which the flap is placed substantially orthogonally to the endplate or frame; and drive means for driving the moving member between its two positions.

These two apparatus may be associated together, or they may be distinct from each other. The apparatus for folding down the flaps may be associated with a packaging machine having a turntable like a conventional type of presser, or with a packaging machine having a support plate that is stationary.

BRIEF DESCRIPTION OF THE DRAWINGS

Embodiments of the invention are described hereinafter by way of example with reference to the accompanying drawings, in which like reference characters designate like or corresponding parts throughout the several views, and wherein:

FIGS. 12 and 13 are two diagrammatic views, respectively a vertical elevation view and a plan view of a turntable machine of the invention for providing outer packaging by a winding operation, and for simultaneously providing the outer packaging of the load and for holding the angle strips in place;

FIGS. 14A to 14I are nine diagrammatic elevation views showing the steps of one possible method that can be implemented using the machine of FIGS. 12 and 13, that is, the initial or starting situation in which a load is on the turntable and a top endplate or frame is about to be grasped (FIG. 14A), said endplate or frame is deposited on the horizontal top face of the load with its margin in the unfolded state, and the apparatus for feeding and depositing the endplate or frame is about to be withdrawn (FIG. 14B), since said apparatus is distinct in this embodiment from the apparatus for folding down the margin of the endplate or frame it is withdrawn and the apparatus for folding down the margin of the endplate or frame (literally vertically downwards) is brought into position (FIG. 14C), the angle strips are put into position (FIG. 14D), while the angle strips are still held by the apparatus for putting them in position the apparatus for folding down the margin of the endplate or frame is put into operation, thereby folding down the margin of the endplate or frame (FIG. 14E), with the angle strips being held in place at the top by the folded-down margin of the endplate or frame, the turntable is rotated together with its load and the apparatus for folding down the margin of the endplate or frame, and winding of the film can begin (FIG. 14F), when winding of the film comes to an end the turntable is stopped (FIG. 14G), the load is ready to be removed, the apparatus for folding down the margin of the endplate or frame is retracted and its fingers are folded back to a horizontal position, and the load is removed (FIG. 14H), and the machine is ready for a new cycle (FIG. 14I);

DETAILED DESCRIPTION

Figure 1:
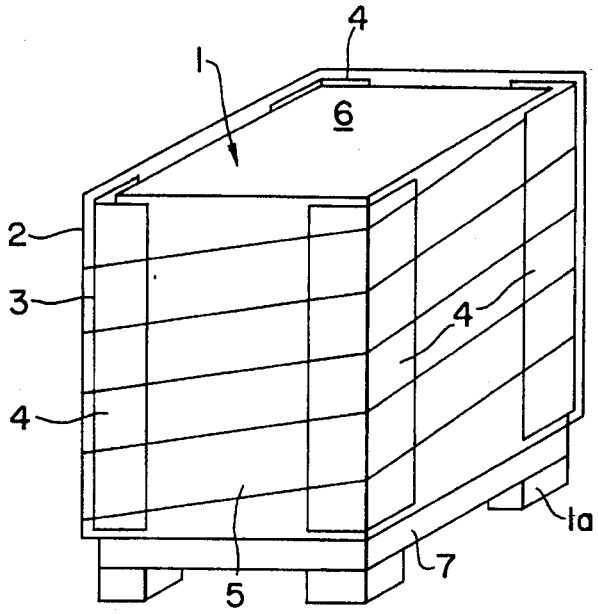
FIG. 1 is a diagrammatic perspective view of a palletized load provided with angle strips and with an outer packaging film that surrounds the load and the angle strips and that participates in holding the angle strips on a permanent basis.

The invention relates to packaging a load that includes at least one separate and added-on protective angle strip 4 on at least one of its edges 3, which strip is rigidly secured to the load 1. In a variant implementation, such a strip 4 is interposed between the load 1 and an outer packaging film 2.

In a preferred but non-limiting implementation shown in the figures, the load 1 is a prismatic palletized load (in particular in the form of a rectangular block) delimited by four vertical lateral faces 5, a top horizontal face 6, and a bottom horizontal face 7 which stands on a pallet or which forms a false pallet. Under such circumstances, the edges 3 are preferably the four vertical edges between and interconnecting the faces 5, however they may also include the four horizontal edges delimiting either of the horizontal faces 6 and 7. The angle strips used, 4, have a general longitudinal direction that is then respectively substantially vertical or substantially horizontal.

The invention is applicable to other kinds of loads, and in particular to a load whose longitudinal direction extends horizontally, in which case its edges 3 (and the protective angle strips 4 applied thereto) are horizontal (not shown).

As considered herein, a machine for providing outer packaging of a load 1 by means of the outer packaging film 2 serving to hold the angle strips 4 in place and/or to provide outer packaging per se of the load, comprises in general:

load support means 8;

feed means 9 for feeding the film 2 which comes from the feed means 9; and moving means 10 for enabling at least a portion of some of the faces carried by the support means 8 to be covered with the film 2 from the feed means 9.

Figure 7:
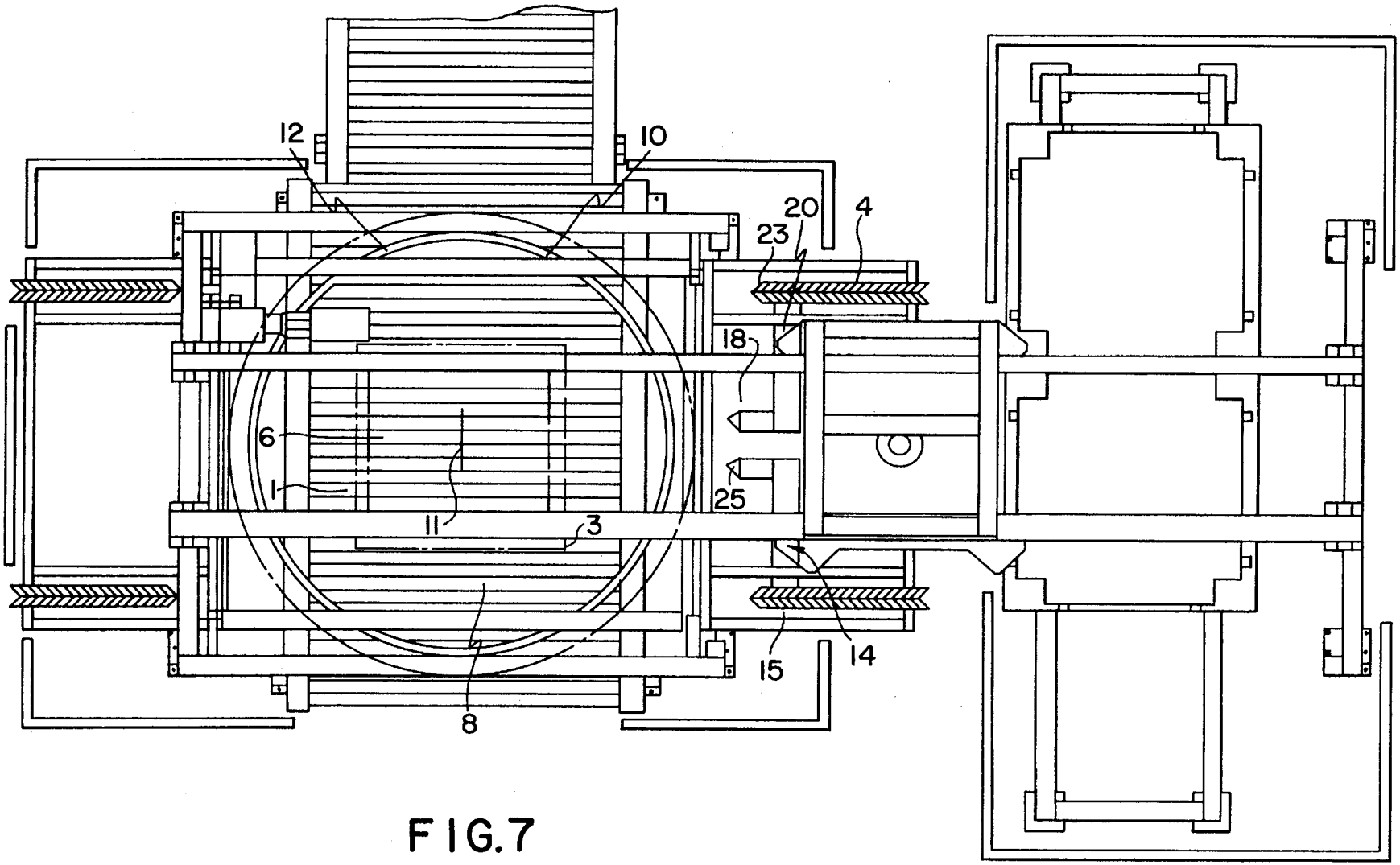
FIG. 7 is a plan view of a machine of the invention for applying outer packaging to the vertical lateral faces of a palletized load by a winding operation, the machine of the invention being of the type having a fixed load-supporting plate and a reel of film whose axis rotates around the load helically, thereby simultaneously putting the outer packaging into place on the load and holding the angle strips in place.
Figure 8:
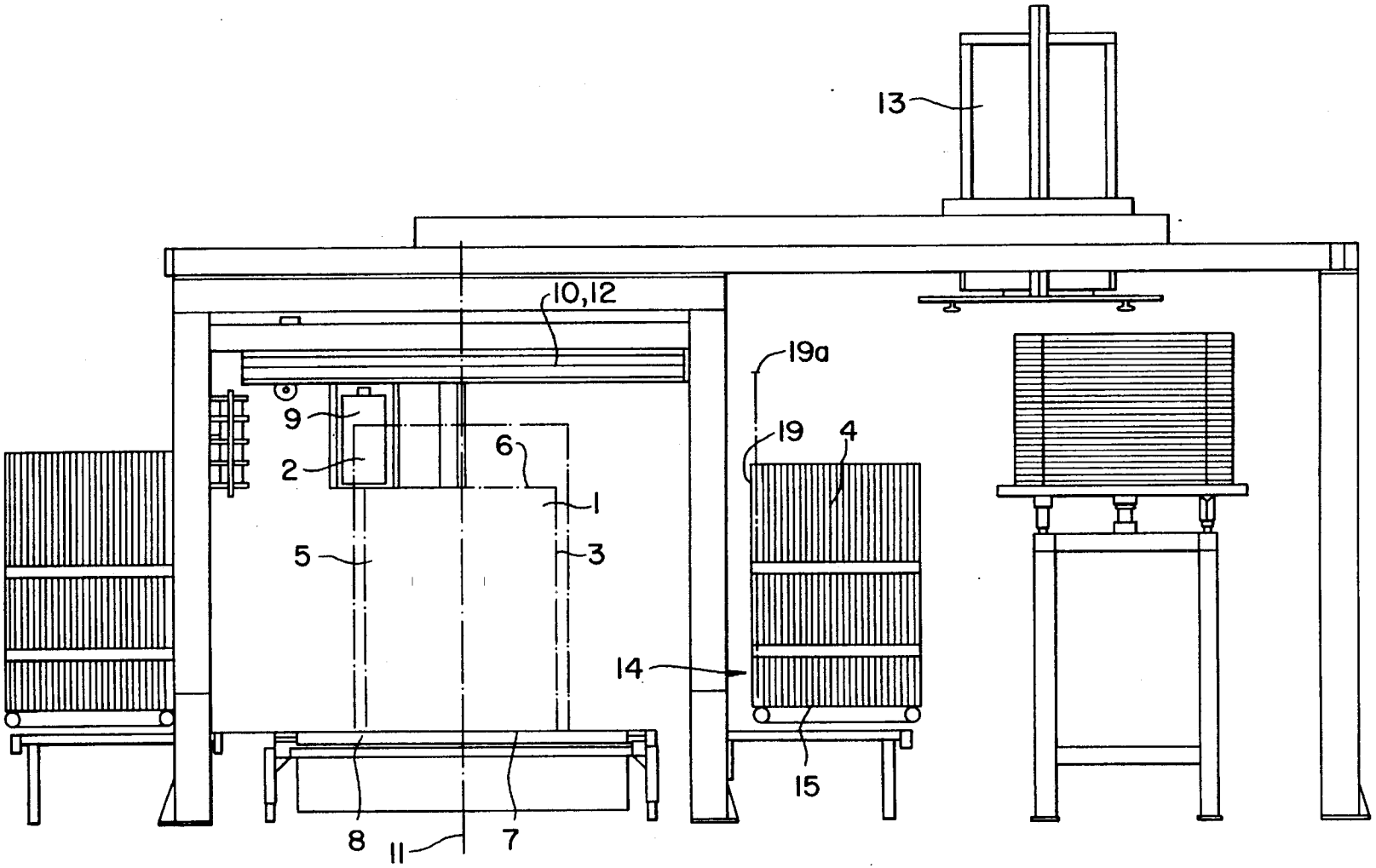
FIG. 8 is a vertical elevation view of the machine of FIG. 7.
Figure 9:
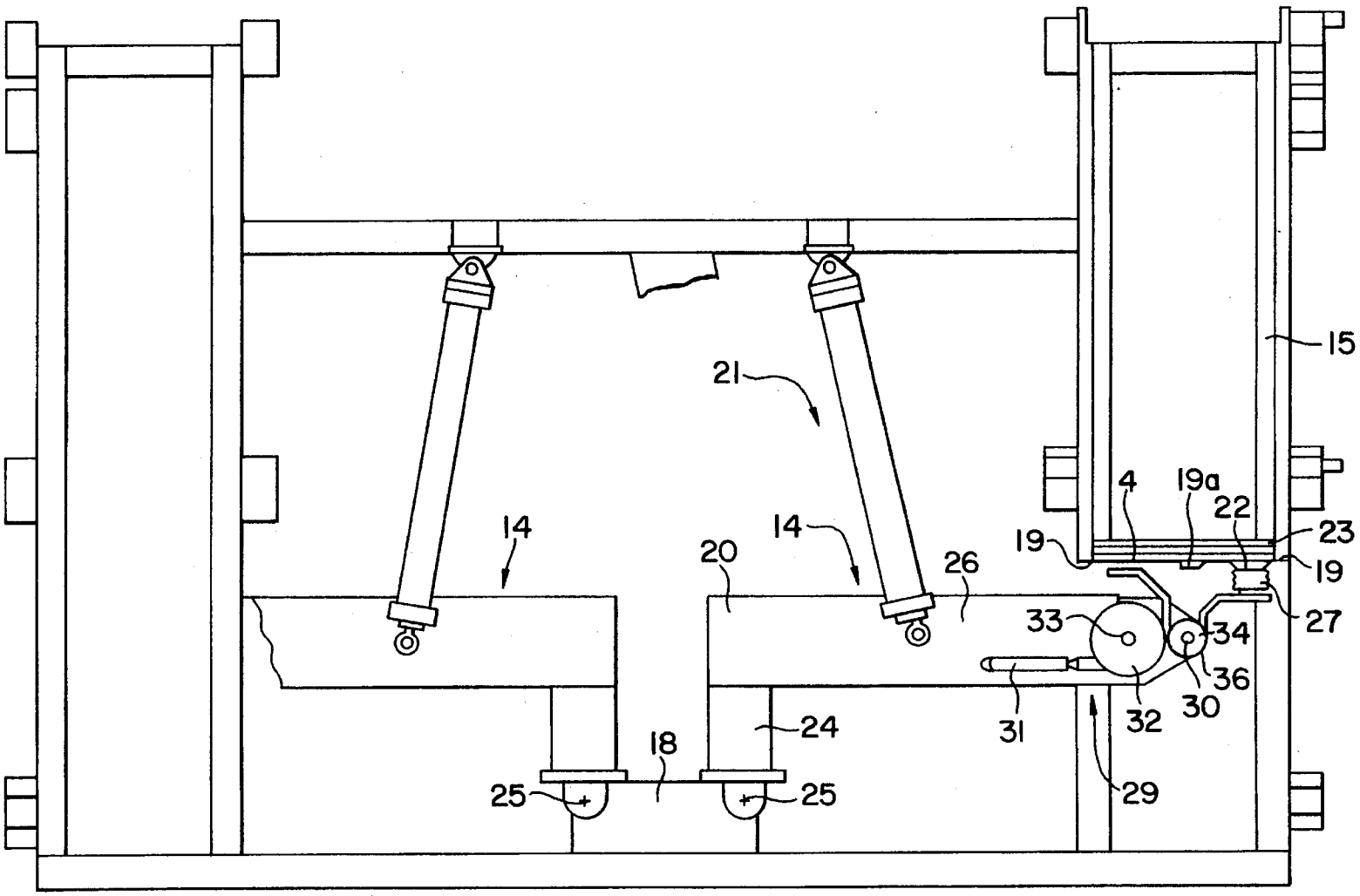
FIG. 9 is a fragmentary plan view on a larger scale of apparatus for grasping, displacing, depositing, and holding angle strips.

In the embodiments considered more particularly, the support means 8 is constituted by a support plate having a substantially vertical axis 11 as seen for example in FIGS. 7 and 8. The feed means 9 comprises a reel of film in strip form (for providing outer packaging by winding or wrapping the same about the load) or in the form of a flattened tube (for providing outer packaging in the form of a tube covering). The moving means 10 comprises: either means for causing the plate 8 to rotate about its axis 11 relative to the film reel 9 or to the film coming therefrom, or with the plate 8 being stationary and the reel 9 of film in strip form rotating thereabout, or else with the plate 8 being a turntable rotating about its vertical axis 11 while the reel 9 of film in strip form has a vertical axis whose position remains stationary (for providing outer packaging by winding about the load); or else means for opening the tube coming from a reel 9 of flattened tube stock and for fitting the tube opened in this way over the load 1 carried on the plate (outer packaging by means of a tube covering).

For a machine that provides outer packaging by winding the film around a stationary load-supporting plate as shown in FIGS. 7 and 8, the plate 8 is stationary and the means 10 comprises a ring 12 about the axis 11 as supporting the reel 9 of film, the ring being mounted to move parallel to the axis 11 between a bottom position close to the horizontal plane of the plate 8 and a parallel top position distant from the table 8, and in particular at a level slightly above the level of the top horizontal face 6. The ring 12 defines a path, and in particular a circular path, to be followed by the axis of the reel 9 of film around the vertical lateral faces 5. Given the axial movement of the ring 12, the reel 9 of film performs not only rotation about its own axis given that it is paying out film, but also helical motion about the axis 11.

Instead of using a ring 12 in such an outer packaging machine, it is possible to use means that supports an equivalent reel 9 of film and that ensures that the reel or its axis follows a path that is identical or equivalent. Such means could be constituted, for example, by an angled arm (having a horizontal top portion and a downwardly extending vertical portion) having its horizontal length rotating about a vertical axis that is parallel to and distant from its vertical length.

With such an outer packaging machine, it is possible to wind the film 2 in strip form from the reel 9 around the load 1 and the angle strip(s) 4. To this end, the following steps are performed in succession: an initial free end portion of the strip of film 2 is associated with the load 1; relative displacement is provided between the load 1 and the reel 9 of film in such a manner as to cause the axis of the reel 9 of film to rotate about the axis 11 of the load; the strip of film 2 is cut transversely once wrapping has been completed; and a free end portion of the strip of film 2 is associated with the film that has already been wound on the load.

An outer packaging machine for covering the vertical lateral faces 5 of a load 1 by winding a film thereabout and for simultaneously providing the outer packaging of the load and holding the angle strips in place may also be of the type having a turntable 8 that rotates about its own vertical axis 11 by means of a stub axle 8*a*, with the reel of film having an axis whose general direction is vertical and which remains stationary. Such a machine is shown in FIGS. 12 and 13, as well as in FIGS. 14A–14I. It is derived from a conventional machine of this type and known in the state of the art. It differs by the presence of apparatus 54 replacing a top presser plate and serving to fold down the projecting margin or flap 53 of a top endplate or frame 52 placed on the top face 6 of the load 1, said apparatus 54 being disposed like such a presser plate, that is, being carried so as to be free to rotate about an axle 48 situated above and in alignment with the axis 11 of the turntable 8, and carried by a bracket 49 slidably mounted on a column 50 forming part of the chassis of the machine so as to be capable of sliding upwards and downwards under drive from drive means. As a result, the apparatus 54 for folding down the margin of the endplate or frame can be applied to the top horizontal face 6 of a load 1 placed on the turntable 8 and can rotate simultaneously therewith. The column 50 also receives film feed means 9 that generally comprises a carriage which is also generally mounted to slide vertically. The apparatus 54 may be incorporated in apparatus 51, as seen in FIG. 15, for feeding the endplate or frame, with both of the apparatus 51 and 54 being described below.

An outer packaging machine implemented in the invention for providing the outer packaging of a load and/or for holding an angle strip in place may also be of the "curtain" type (not shown), where the load slides horizontally on a conveyor to meet a vertical curtain of film having a general longitudinal direction that is horizontal between two reels of film having vertical axes. The curtain is thus deformed into a U-shape which is subsequently closed together around the load and is finally welded together transversely and then cut. Alternatively, the invention may be applied to a machine of the type that applies a tubular film, in particular of the bellows type, which is initially flattened and which is then opened outwardly by members such as belts, fingers, suction boxes, or equivalents, and is then fitted in the open condition over the load from above. In this case such a "tube covering" type packaging machine successively opens the tube, fits it over the load and the angle strip, and then cuts the tube to the appropriate length.

The outer packaging machine used may also include a horizontal axis reel of film (not shown) rotating about a load that is elongate in a horizontal direction, and that is movable to slide along said elongate direction.

The film 2 may be perforated like a net, or it may be unperforated. It may be a stretch type film or a heat-shrink type film. If it is a stretch film, then the film is preferably pre-stretched before being put into place on the load.

A load 1 is covered with film 2 by an outer packaging machine as described above in such a manner that the film surrounds the load (in at least one direction) and also the angle strip(s) thereon. The film covers the corresponding faces of the load in said direction completely or only in part. Depending on the dimensions of the film used, the covering either comprises a single width of film or else comprises a plurality of juxtaposed lengths, in particular when covering is performed by a helical winding operation. The helical winding may be crossed upwards and downwards.

In the embodiment of the outer packaging machine shown in FIGS. 7 and 8, apparatus 13 is also provided for depositing a flexible sheet of outer packaging film on the top horizontal face 6 of the load 1.

As mentioned above, such an outer packaging machine as described above may be implemented not only for providing the outer packaging of a palletized load 1 provided with one or more angle strips 4, when such outer packaging is desired, in which case the outer packaging operation takes place after a packaging operation, but also to provide substantially on its own or in combination with the outer packaging, retention of the angle strip(s) 4 that are otherwise held temporarily on the load 1. When it is desired to implement the outer packaging machine so that it retains the angle strip(s) 4, then an angle strip 4 is initially placed on the appropriate edge 3 by means of apparatus 14 for grasping, displacing, depositing, and temporarily holding the strip, which apparatus is further described below. Thereafter, the load 1 is covered with the film 2 by means of the outer packaging machine. The angle strip 4 as held in place by the apparatus 14 is also covered, at least in part, so as to ensure that it is held captive by the film 2 applied to the load, and consequently that it is held in place solely by the outer packaging film. The apparatus 14 for grasping, displacing, depositing, and holding an angle strip 4 is then used, which apparatus is located between a magazine 15 for containing a supply of protective angle strips 4 and the edge 3 of the load 1 that is to have an angle strip 4 fitted thereto. A protective angle strip 4 is taken from the magazine 15 and is deposited on the edge 3 of the load by means of said apparatus 14. Using said apparatus 14 on its own, the protective angle strip 4 brought in this way to the edge 3 is temporarily held in place in a first zone 16 thereof while the angle strip 4 is simultaneously covered with packaging film in a second zone 17 of the strip different from the first zone 16 as seen, for example, in FIGS. 10 and 11, and this is continued at least until the packaging film 2 has gone once round the load 1, thereby covering both the load and the angle strip 4 and ensuring that the angle strip is held in place. Once the angle strip 4 is held in this way by the packaging film 2, the apparatus 14 is disengaged from the angle strip 4, and covering of the load 1 and the angle strip 4 with the packaging film 2 is continued.

In the embodiment under consideration, the length of an angle strip 4 is substantially the same as the length of the corresponding edge 3 of the load. In this embodiment, the first zone 16 is constituted by the bottom half of the angle strip 4 while the second zone 17 is constituted by its top end portion. In other possible variants, the zones 16 and 17 are different.

In the embodiments shown in the figures, the protective angle strips 4 are put into place on the four substantially parallel lateral edges 3 of the load 1. Such installation is performed by a plurality, in particular four, of separate apparatus 14 operating simultaneously and synchronously for the purpose of grasping, displacing, depositing, and holding respective angle strips.

In general, such an apparatus 14 comprises:

a chassis 18;

an angle strip magazine 15 disposed so that angle strips 4 are stored therein with their outside angles directed towards the outlet opening 19 of the magazine 15, in particular with the angle strips being engaged within or superposed upon one another;

a support arm 20 carried by the chassis 18 and movably mounted so as to move between two extreme positions: a grasping position and a common position both for depositing and for holding, which positions are respectively close to the outlet opening 19 of the magazine 15, and distant therefrom while being close to an edge 3 of the load 1;

first drive means 21 acting on the support arm 20 to drive it between and to lock it in its two end positions;

grasping and holding means 22 for grasping and holding an angle strip 4 essentially by means of its outside angle in the first zone 16 thereof, the means 22 being carried by the support arm 20 and occupying either an active state or an inactive state;

specific control means for specifically controlling the grasping and holding means 22 enabling it to pass between two states and for temporarily holding it at one or the other of the two states; and overall control means for coordinating the first drive means 21 and the specific control means.

The outlet opening 19 of the magazine 15 has an elongate shape that is substantially complementary to the shape of the protective angle strips 4. Such an opening 19 thus has a longitudinal direction 19*a* that is substantially parallel to the general longitudinal direction of the angle strips 4. Its longitudinal edges 19*b* are substantially parallel to the direction 19*a*.

In order to ensure that the outside angle of an angle strip 4 is directed both towards the outlet opening 19 when the angle strip 4 is inside the magazine 15, and away from the load 1 when the angle strip 4 is mounted upon the load, even though the outlet opening 19 generally faces the load 1, the method is such that, during displacement of a protective angle strip 4 from the magazine 15 to the corresponding edge 3 of the load 1 by means of one of the apparatus 14, said apparatus 14 also ensures that the angle strip 4 pivots through about 180° about its own general longitudinal direction.

In a first variant embodiment, angle strips are used that are preformed and that are stored in the preformed state, and these strips are grasped, displaced, deposited, and held while substantially in said preformed state.

In a second variant embodiment, the angle strips are initially flat, they are grasped and displaced while in said flat state and they are given the desired angle configuration by being deformed in situ on the corresponding edge 3 of the load 1. To this end, an angle strip is grasped solely in the vicinity of its longitudinal edges 23, and these two edges 23 are pressed against respective sides 5 of the load 1.

In the embodiment under consideration, the support arm 20 is a moving arm that pivots since it is mounted as such by means of a first end portion 24 to the chassis 18 about a stationary hinge axis 25 which is substantially parallel to the general longitudinal direction 19*a*.

The grasping and support means 22 is supported at the second end portion 26 of the support arm 20.

In this embodiment, the first drive means 21 comprises an actuator which causes the support arm 20 to pivot about the axis 25 between its two end positions. These end positions are spaced apart by a fraction of a turn, for example, by about one-eighth of a turn.

In other possible embodiments (not shown), the support arm 20 may be: pivotally mounted about an axis that is differently disposed or arranged; slidably mounted, in particular to slide horizontally towards the edge 3 to be covered by the angle strip; hinged about a point; carried by a handling robot; or finally, movable in a combination of the above kinds of movement (hinged, pivoting, sliding). Movement is thus more or less complex depending on the displacement that needs to be imparted to the angle strip between the magazine 15 which may be at a greater or lesser distance from the load 1, or from the support means 8 and the load 1, or from the support means 8.

The grasping and holding means 22 may be implemented by at least one suction cup 27 which is situated substantially in the opening 19 of the magazine 15 when the support arm 20 is at its grasping position, in which case the open face of the suction cup 27 is suitable for taking hold of an angle strip 4 in the opening 19 of the magazine 15 by means of the outside angle thereof.

In the embodiment described, provision is made for at least two suction cups 27 which are situated close to the longitudinal edges 19*b* of the outlet opening 19 of the magazine 15 when the support arm 20 is at its grasping position.

The suction cups 27 are associated with suction means that can be switched off and on, so that when the suction means is in operation, that is, when the suction cups are in an active state, air is sucked in through their grasping faces. When the suction means are switched off, the suction cups is in an inactive state and they no longer suck in air.

Such suction cups 27 are commonly used in packaging. They need no further description. They may be replaced by equivalent members such as a suction box or even grasping fingers or clamps.

Figure 10:
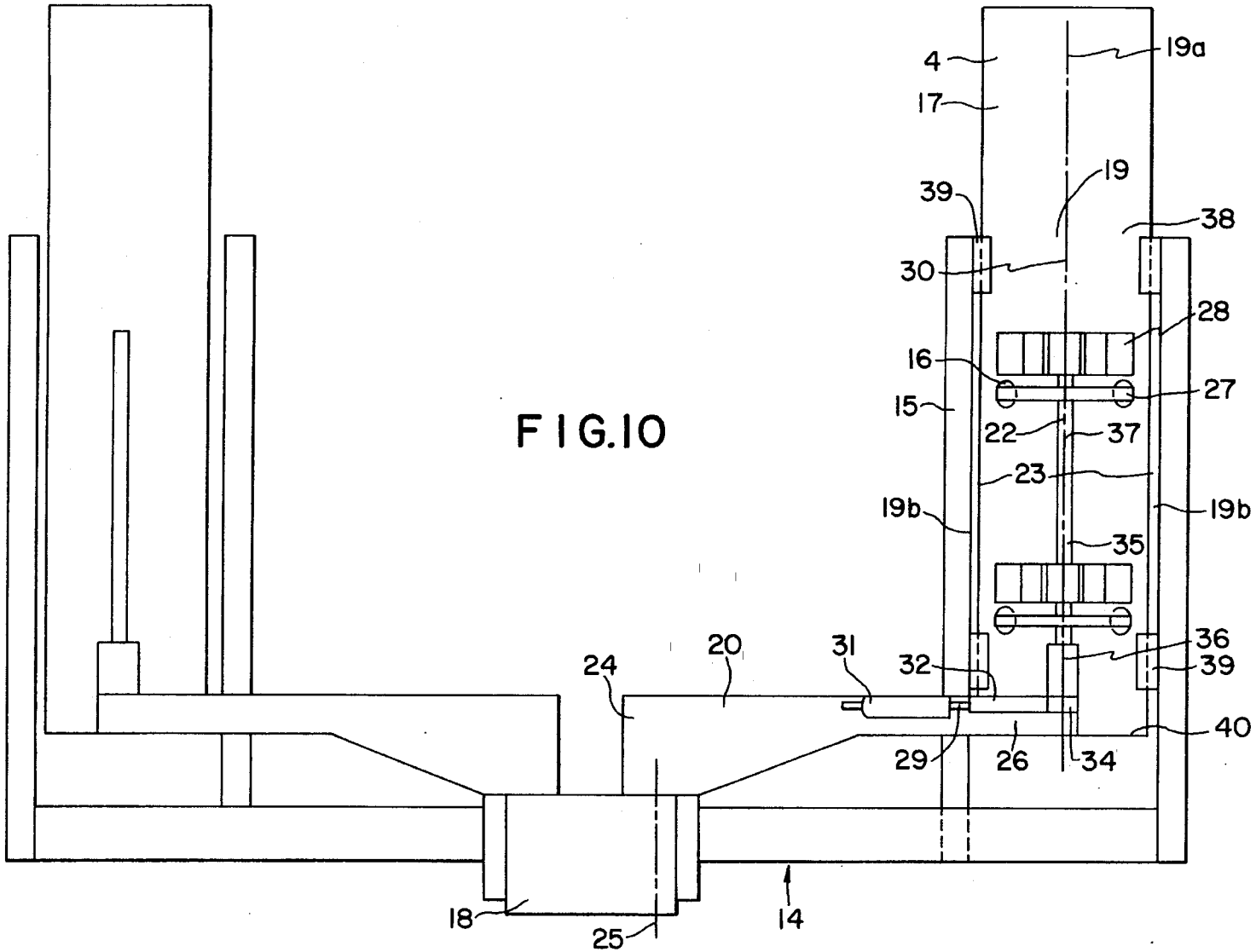
FIG. 10 is a front elevation view of the FIG. 9 apparatus.

Provision is also made for the grasping and holding means 22 to include at least one generally angular shaping member 28 as seen in FIG. 10. Such a shaping member 28 is intended to apply pressure to the outside angle of a protective angle strip 4 while it is being deposited so as to ensure that it fits the load 1 properly at and in the vicinity of its edge 3 with no significant clearance between the load 1 and its protective angle strip 4. Such a shaping member can be used not only with preformed angle strips, but also with angle strips that are initially flat, thereby shaping them around the edge.

In the embodiment described, in addition to the support arm assembly 20 being movable, provision is made for the grasping and holding means 22 to be movably mounted relative to the support arm 20 between two extreme positions, that is, a grasping position and a depositing position. To this end, second drive means 29 is provided for the grasping and holding means 22 to displace the means 22 between its two end positions and to enable it to be locked in either position. The above-mentioned overall control means coordinates the second drive means 29 with the first control means and with the specific control means.

In particular, the grasping and holding means 22 is pivotally mounted on the support arm 20 in its second end portion 26 about a hinge axis 30 which is substantially parallel to the general direction 19*a* and also to the axis 25. Under such circumstances, the second drive means 29 comprises an actuator 31 which is hinged firstly to the support arm 20 adjacent to the second end portion 26, and secondly to a toothed wheel 32 rotatably mounted at 33 on the support arm 20 and meshing with a gear wheel 34 constrained to rotate with the shaft on the axis 30. With such a structure, the second drive means 29 causes the grasping and holding means to pivot between two extreme angular positions that are separated by a fraction of a turn, and in particular by about half a turn.

The second drive means 29 may be implemented in other ways, that correspond equally well to the same displacement dynamics of the grasping and holding means 22, or to some other dynamics.

The overall control means is arranged to allow the following situations to take place:

With the support arms 20 in the grasping position, the grasping and holding means 22 is in the grasping position. The means 22 is then located in or in the immediate vicinity of the opening 19. The means 22 is then either in the active state or in the inactive state. When in the active state, the suction cups 27 suck up and thus grasp a protective angle strip 4. While in the inactive state, the suction cups 27 cannot hold a protective angle strip 4. This occurs while the apparatus 14 is in a wait state.

The support arm 20 may be in a depositing and holding position. The grasping means 22 is in a depositing position. It is then at a distance from the magazine 15 and it is situated in the immediate vicinity of the corresponding edge 3. Under such circumstances, the means 22 can either be in the active state where it continues to hold the protective angle strip 4 effectively, or else it can be in the inactive state for the purpose of releasing the protective angle strip 4, and once the strip has been pressed against the edge 3 it can return towards the magazine 15.

Starting from an initial situation in which the support arm 20 is in the grasping position, and the grasping and holding means 22 is in the grasping position but in the inactive or waiting state, the overall control means ensures that the following sequence takes place:

a/ the grasping and holding means 22 switches to the active state;

b/ the support arm 20 moves to the depositing and holding position and the grasping and holding means 22 moves to the depositing position;

c/ while said support arm 20 and said means 22 are in the above position, the means 22 is switched to the inactive state; and d/ the support arm 20 and the grasping and holding means 22 move back to the grasping position.

Step a/ serves to grasp the protective angle strip 4 that is to be found in the opening 19 of the magazine 15, with the strip being grasped in a zone 16 thereof. During step b/, the two displacements mentioned above may take place simultaneously or separately. Step b/ enables the angle strip carried by the means 22 to be transported towards the load and the corresponding edge 3. In step c/, the protective angle strip 4 is released by the holding means 22. This is made possible without significant movement of the protective angle strip 4 since the film 2 simultaneously holds the second zone 17 of the angle strip 4 pressed against the load 1. In step d/, the apparatus returns to its waiting state. Step d/ takes place in "masked" time since the load 1 and the angle strips 4 continue to be covered with film while step d/ is taking place. Similarly, step a/ and the beginning of step b/ may take place while the film 2 is being deposited on the load 1 possibly even on the edge 3 which is to receive the angle strip 4. At the end of step b/, the edge 3 should be free of the film 2 so as to allow the angle strip 4 to be applied to said edge 3.

The grasping and holding means 22 preferably comprises a support bar 35 extending substantially parallel to the general longitudinal direction **19*b* of the outlet opening 19 of the magazine 15 with a plurality of pairs of suction cup and shaping member assemblies 27, 28 disposed therealong as seen in FIG. 10. The support bar 35 is then placed in the middle of the opening 19, with the suction cups 27 and the shaping members 28 being situated on either side of the support bar 35. In the embodiment under consideration, there are two pairs of suction cup and shaping member assemblies 27, 28, one at each of the top and bottom ends 37 and 36 of the support bar 35. The support bar 35 is rotatably mounted on the support arm 20. The gear wheel 34, and more generally the second drive means 29, is situated at an end portion of the support bar 35, and in the present case at the bottom end portion 36 where the support bar 35 is carried by the support arm 20**.

The support arm 20 and the grasping and holding means 22 are located in sectors about the general longitudinal direction of an angle strip. This disposition makes it possible to hold the protective angle strip 4 in its first zone 16 only while leaving its second zone 17 free.

To make the apparatus 14 versatile in operation, that is, to make it possible to use angle strips 4 of different lengths (that is, heights when the angle strips have a general direction that is vertical and in the embodiment described), provision is made for the magazine 15 to include a transverse end 38 (in this case the top end) which is open and through which the angle strips 4 are free to project to a greater or lesser extent. Under such circumstances, the magazine 15 also includes projections 39 for supporting the first angle strip that is located in the opening in the vicinity of the suction cups 27, together with transverse ends 38 and 40, with the end 40 being a bottom end close to the horizontal plane of the support arm 20.

In the embodiment described, the apparatus 14 also includes means 41 suitable firstly for continuously urging an angle strip into the outlet opening 19 of the magazine 15 regardless of the extent to which the magazine 15 is filled, and secondly for exerting a force at least on the angle strip in said opening 19 that tends to prevent it from moving back into the magazine 15. This constructive disposition is particularly effective when the angle strips are disposed vertically and are long (in the present case tall), for example, about 2 meters long. Otherwise there could be a danger of the angle strips 4 falling over or, when the apparatus 14 is moved to grasp an angle strip in the opening 19, the angle strip might move back into the magazine which would prevent it from being grasped by the grasping and holding means 22.

Figure 11:
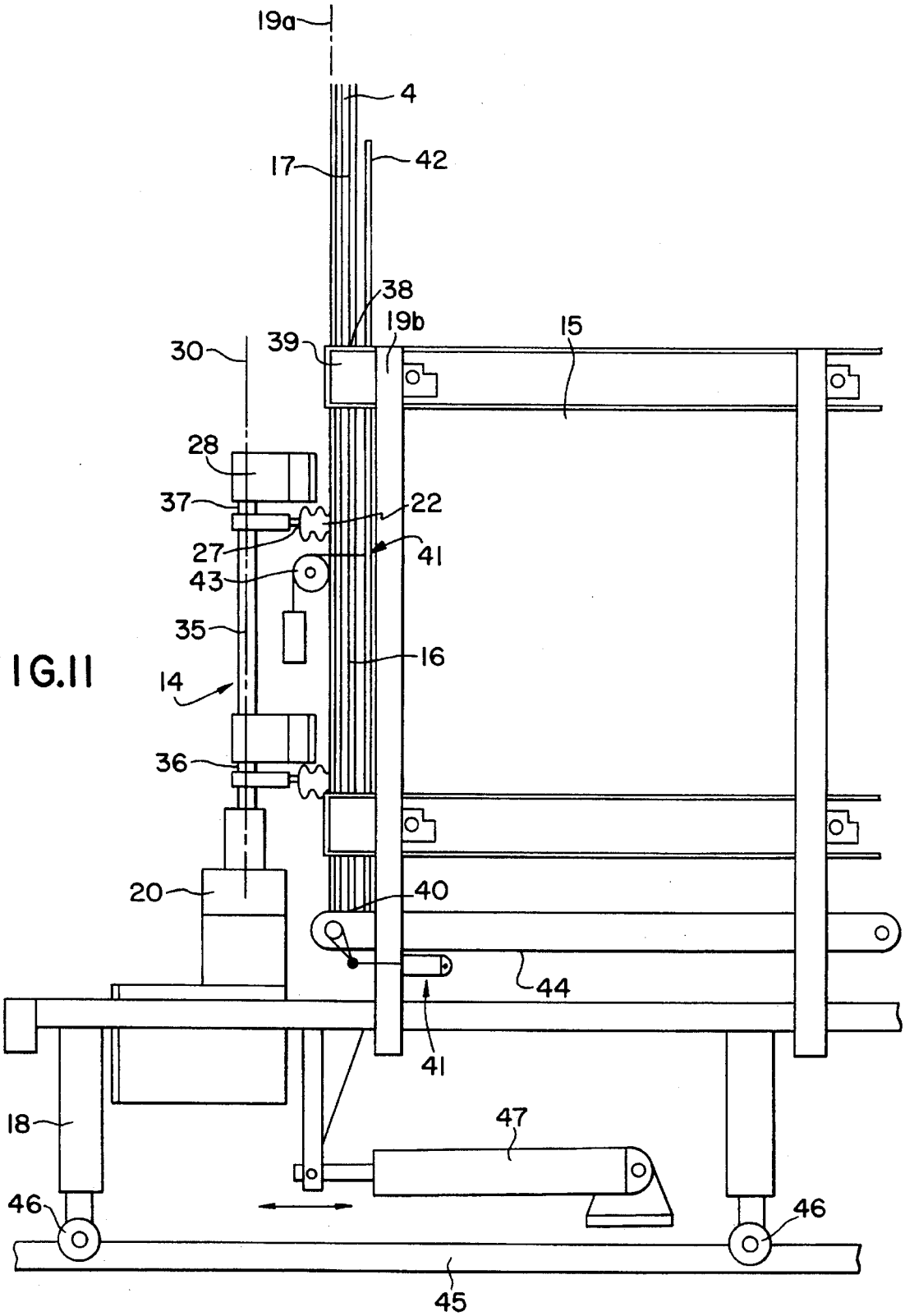
FIG. 11 is a side elevation view of the FIG. 9 apparatus.

For example, as shown in FIG. 11, the means 41 may comprise a rear thrust plate 42 bearing against the angle strips and slidably movable transversely, wherein the plate is urged towards the outlet opening of the magazine by an appropriate member 43 such as a weighted pulley system, and the lower end of the plate 42 is also disposed upon a conveyor 44 for supporting the angle strips in the magazine 15. Other embodiments could be envisaged, using means that are mechanical, electrical, or pneumatic.

In accordance with the invention (FIG. 11), the apparatus 14 is disposed in a packaging machine so as to be capable of being adjusted as a function of the size of the load 1. Such adjustment requires the grasping and holding means 22 to be placed at a variable distance relative to the axis 11 in the deposition and holding position, and at a given orientation. To this end, in one possible embodiment, the chassis 18 is mounted so as to be displaceable overall and lockable in the required position for the purpose of adjusting the apparatus as a function of the size of the load 1 under consideration, by using movable support means 46, in particular wheels 46 and drive means 47 under the control of the control means of the apparatus. In particular, the chassis 18 is mounted to be slidably movable in a direction substantially orthogonal to the longitudinal direction of the outlet opening 19 of the magazine 15. The wheels 46 may run on a track 45 on the ground. The actuator 47 may be associated both with the ground or with a support fixed thereto, and also with the chassis 18 or with a support fixed thereto. In addition, the grasping and holding means 22 are displaceably mounted on the support arm 20 so as to move through or with a stroke that is adjustable for the purpose of adjusting the apparatus as a function of the size of the load 1 under consideration, with said adjustment being under the control of the control means of the apparatus. To this end, and by way of example, the actuator 47 may have an adjustable stroke, with the effective stroke of the actuator 47 depending on the size of the load under consideration. Provision is preferably made for the control means to coordinate the displacements of the chassis 18 and the adjustment of the stroke of the actuator 47, in particular in compliance with standard operating programs corresponding to loads 1 of standard dimensions. In a possible variant, the first drive means 21 is made to be adjustable with respect to the stroke of the support arm 20 between its two extreme positions under the control of the control means of the apparatus for the purpose of adjusting the apparatus 14 as a function of the size of the load 1. To this end, and by way of example, the pivoting stroke of the support arm 20 may be greater or smaller since it is adjustable, with the sliding stroke of the actuator in the first means 21 itself being adjustable.

The invention also relates to a packaging machine as described above and associated with at least one apparatus 14 for grasping, displacing, depositing, and holding an angle strip, as also described above.

The pivoting arm structure of such apparatus 14 makes it possible to move the magazines away from the load to be treated or the support means therefor. The space left empty between them allows the packaging or outer packaging means to pass therebetween.

Preferably, and in general, the machine includes a plurality (for example, four) of apparatus 14 for grasping, displacing, depositing, and holding protective angle strips 4 which are substantially similar to one another and which engage the plurality of edges 3 on a load 1 to be packaged.

The plurality of apparatus 14 are organized so that the general longitudinal directions **19*b* are substantially parallel to one another and so that all of the support arms 20 lie substantially in the same common plane (or between two mutually parallel common planes) perpendicular to the direction 19*b***.

The general control means ensures that the plurality of apparatus 14 operate synchronously.

When the plurality of grasping and holding means 22 are in their grasping positions they are maximally spaced apart from one another, and when they are in their deposition and holding positions, they are relatively closer together.

The outer packaging machine under consideration may include a plurality of apparatus 14 which include component members that are common to each other, in part or completely. For example, two of the apparatus 14 may share a common support arm 20 having a cross-member which supports two grasping and holding assemblies for two angle strips 4 and two edges 3.

In the embodiment shown in FIGS. 7 and 8 (using a vertical axis load-supporting support plate 8), the general direction **19*a* of each of the magazines 15 is vertical and the bottom transverse ends thereof 40 are substantially coplanar with the support plate 8. In the same embodiment, the apparatus 14 are placed essentially outside and in the vicinity of the ring 12** and its path.

Figure 14D:
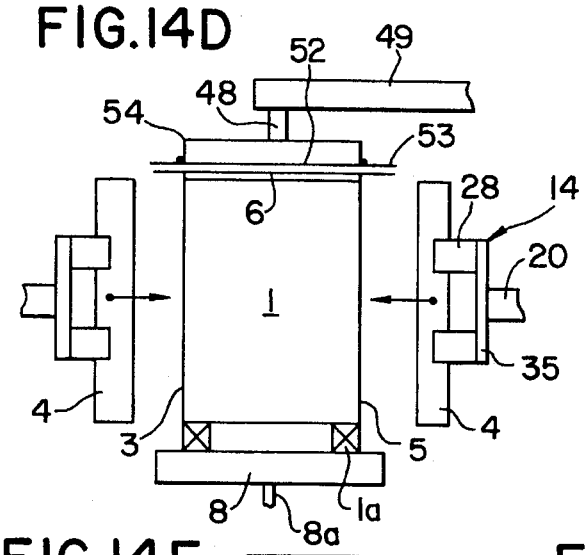
Figure 14E:
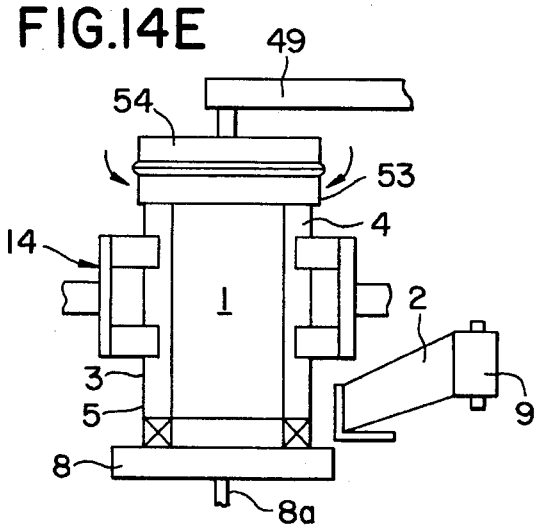
Figure 14F:
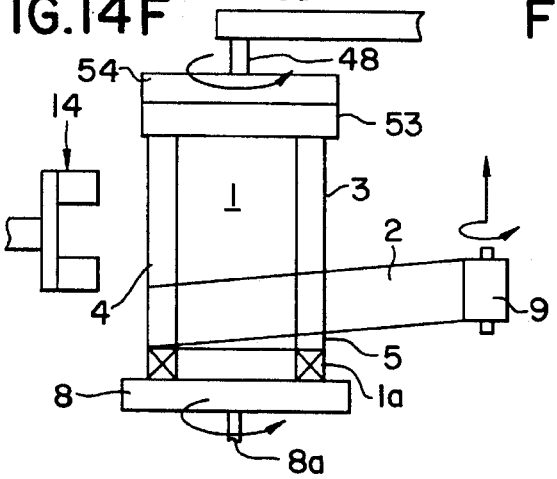
Figure 14G:
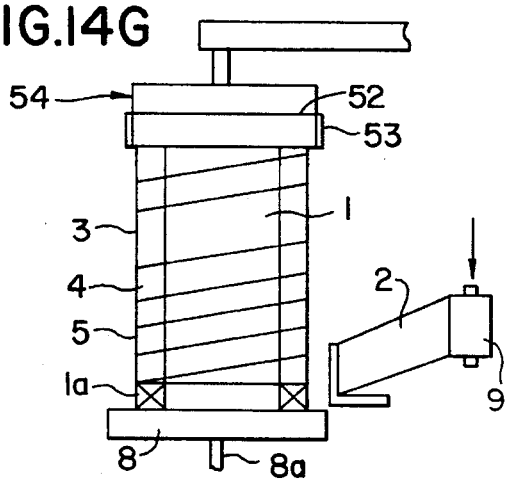
Figure 14H:
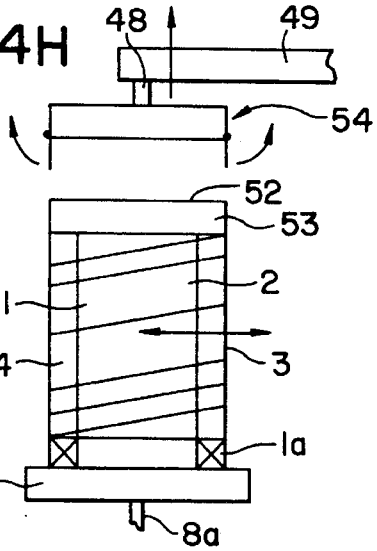
Figure 14I:
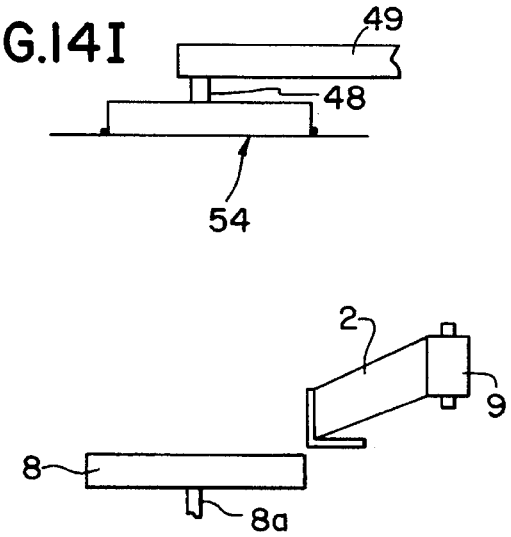
Figure 15:
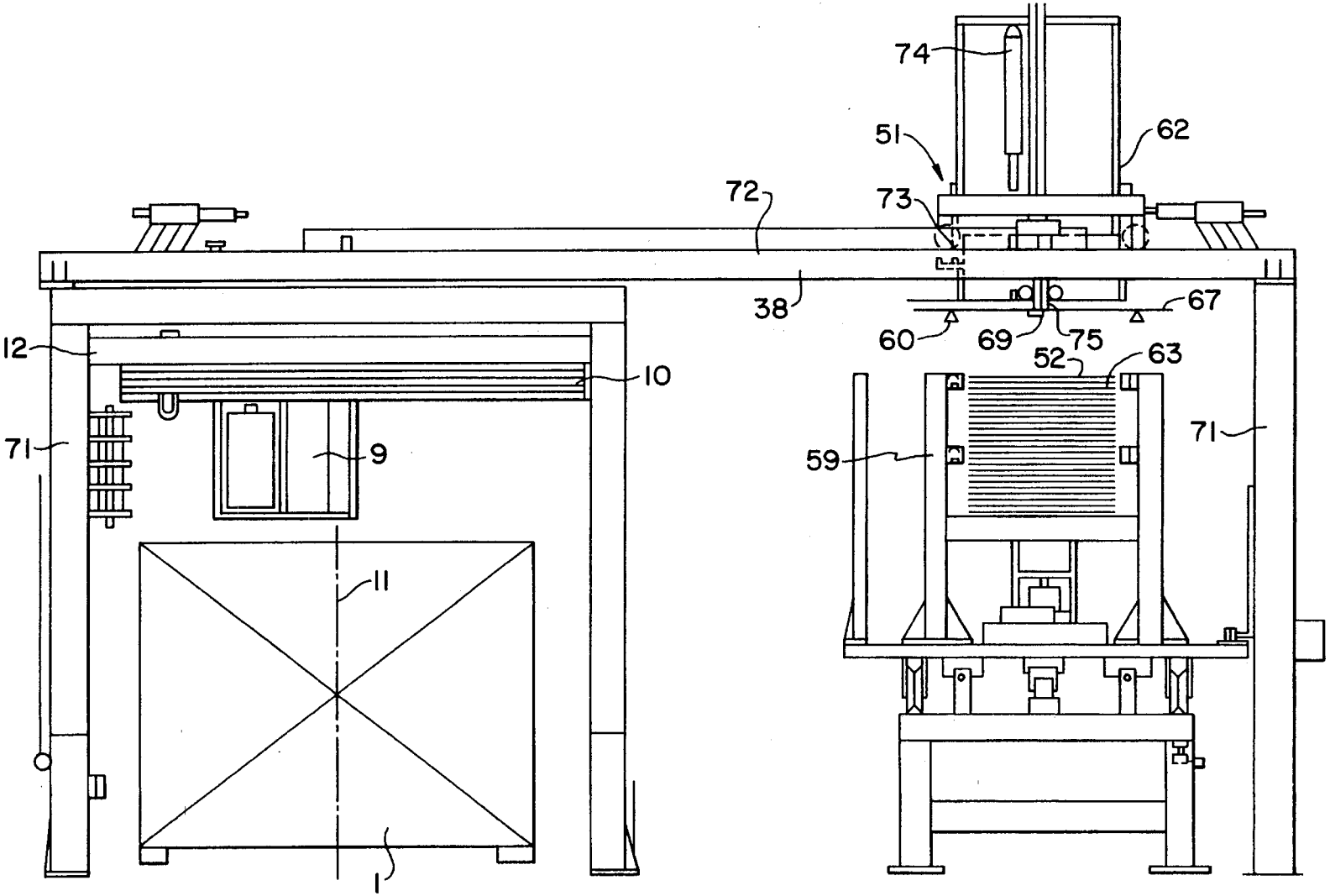
FIG. 15 is a vertical elevation view of a packaging machine of the type having a stationary load-supporting plate and having incorporated therein apparatus for feeding endplates or frames, for reasons of simplicity and clarity this figure does not show the apparatuses for grasping, displacing, depositing, and holding angle strips, and the apparatus for grasping an angle strip may also include apparatus for folding down the margin of an endplate or frame.

The outer packaging machine may also be of various other types, as described, for example, with reference to FIGS. 12 and 13 or with reference to the step-by-step diagrams of FIGS. 14A to 14I, where a rotary plate or turntable 8 is included. The machine then includes apparatus suitable for holding, at least temporarily, the angle strips 4 put into place by the apparatus 14 until they are held captive and are thus retained by the outer packaging film 2. In this particular case, said apparatus may be a functional combination of apparatus 51 for feeding and depositing a top endplate or frame 52 having an outer flap 53, and an apparatus 54 for folding down said flap 53, which was originally coplanar with the remainder of the endplate or frame, substantially perpendicularly towards the load 1 and against the top free end portions of the angle strips 4. The apparatus 54 is carried by the shaft 48 as mentioned above so as to be free to rotate, while the apparatus 51 is mounted on a stationary auxiliary chassis 55 so as to be capable of sliding both vertically up and down, and horizontally between a retracted position at a distance from and vertically above the turntable 8, and also above the top face 6 of the load 1 (FIG. 14B), with the device 54 under such circumstances being retracted as shown in FIG. 12 so as to allow the apparatus 51 to pass by sliding vertically upwards, as shown in FIGS. 14H and 14I. As can clearly be seen in FIGS. 14A to 14I, the apparatus 51 is put into operation first while the apparatus 54 is retracted (FIGS. 14A and 14B). The apparatus 51 is then retracted and the apparatus 54 is put into operation once the angle strips have been put into place and while they are held by the apparatus 14 (FIG. 14E). With the angle strips 4 being thus held temporarily in place by the apparatus 14, wrapping can be commenced, preferably near the turntable 8 (FIG. 14F). The angle strips 4 are thus held captive by the outer packaging film 2 (FIG. 14G). The apparatus 54 can then be removed in turn by sliding vertically upwards (FIG. 14H).

In accordance with the invention, it is also possible to hold the angle strips 4 temporarily or permanently in place by means other than the outer packaging film installed by means of an outer packaging machine as described above.

Figure 2A:
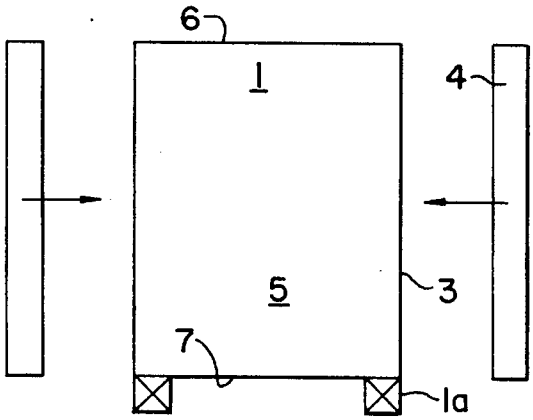
FIGS. 2A, 2B, 2C, and 2D are four diagrammatic elevation views (2C being a right half-view and 2D being a left half-view) showing successive steps in implementing the method of the invention in a variant in which the angle strips are held by two wrapping strips that constitute hoops, that is, the angle strips are put into place (FIG. 2A), they are held on the load, and simultaneously the holding strips are put into place; in the subvariant of FIGS. 2C and 2D, outer packaging film covers the angle strips and the holding strips by winding a packaging film (FIG. 2C) or by fitting a tube covering (FIG. 2D) over the palletized load.
Figure 2B:
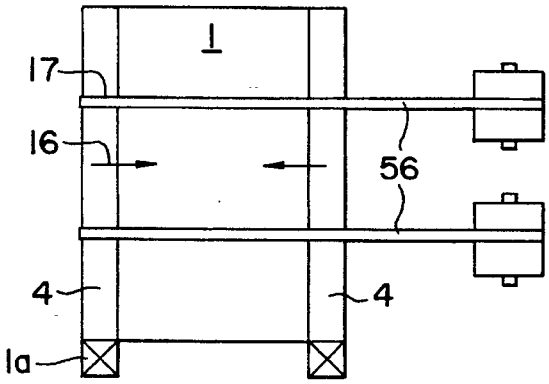
Figures 2C, 2D:
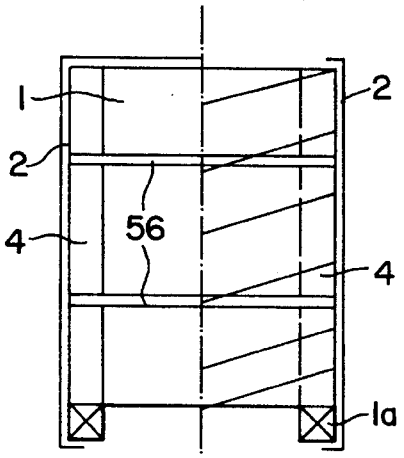
Figure 3A:
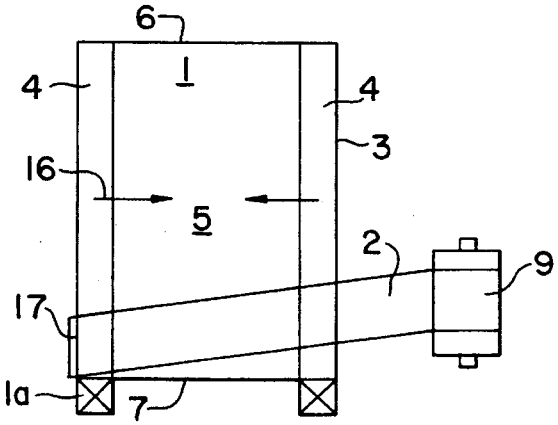
FIGS. 3A, 3B, and 3C are three diagrammatic elevation views showing successive steps in implementing another variant of the method of the invention in which the angle strips are held by packaging film in the form of a strip that is wound helically onto the load and its angle strips, that is, the angle strips are applied to the load and are held in a first zone while winding begins in a second zone (FIG. 3A), winding then continues with the angle strips being held solely by the strip of film (FIG. 3B), and winding then comes to an end (FIG. 3C)
Figure 3B:
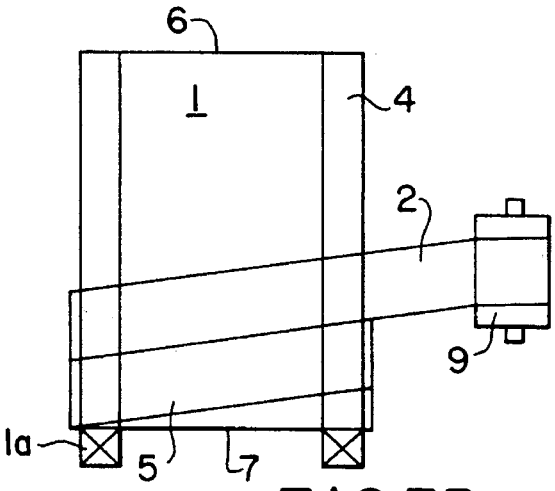
Figure 3C:
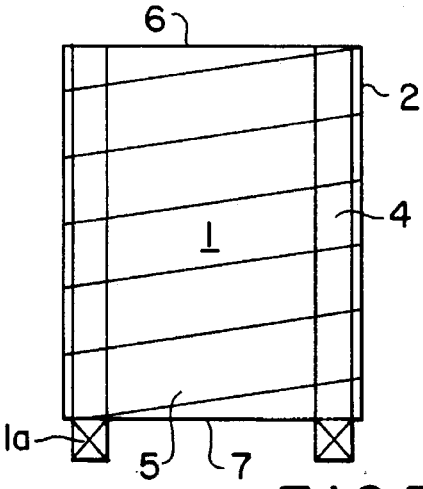

In a first variant, some of the faces of the load 1 or of a packaging element thereof, and the angle strip 4 as held in place by the apparatus 14 are surrounded by at least one wrapping strip placed around the load 1 at least in a second zone 17 different from the first zone 16 so that the wrapping strip serves to hold the angle strip 4 in place. For example, a narrow strip may be used such as a hoop strip 56 which applies localized thrust to the angle strip 4 (FIGS. 2A, 2B, 2C, and 2D). In a subvariant, a plurality of wrapping strips 56 may be installed that are offset from one another. One or more of such wrapping strips serve to retain the angle strip 4 in a second zone 17 which is distinct from the first zone 16 where the angle strip 4 is held in place by the apparatus 14. Such a hoop-forming wrapping strip 56 constitutes an impediment to installing a wide wrapping strip such as the film 2 for outer packaging installed by a winding operation (FIGS. 3A to 3C). The wrapping strip 56 (or possibly the film 2) is put into place in such a manner as to provide straight binding or winding, or else helical winding. As has already been mentioned, it is possible either to leave the load 1 with its angle strips 4 secured by the hoop strips 56 (not shown) or else to provide additional outer packaging (FIGS. 2C and 2D)

FIGS. 3A to 3C correspond to a machine that forms an outer packaging by a winding operation.

Figure 4A:
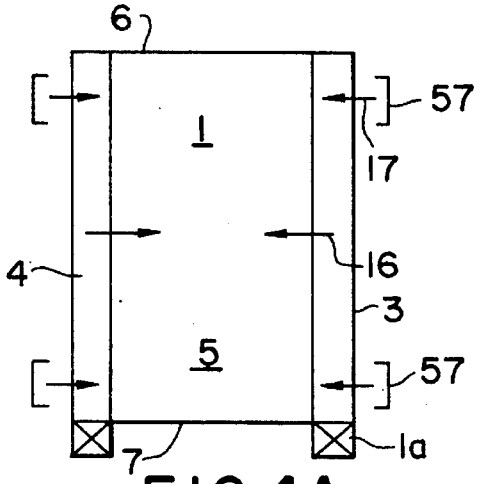
FIGS. 4A, 4B, and 4C are three diagrammatic elevation views (FIG. 4B being a right half-view, FIG. 4C being a left half-view) showing the successive steps in implementing another variant of the method of the invention in which the angle strips are held by staples engaged in the load or in packaging elements thereof (case, pallet), that is: the angle strips are put into place, held against the load, and stapled thereto (FIG. 4A); and an outer packaging film is put into place by being wound helically around the load, the angle strips, and the staples (FIG. 4B), or else the load provided with the stapled angle strips is kept as is (FIG. 4C)
Figures 4B, 4C:
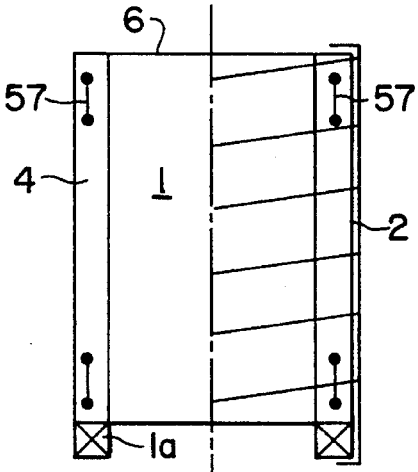
Figure 5A:
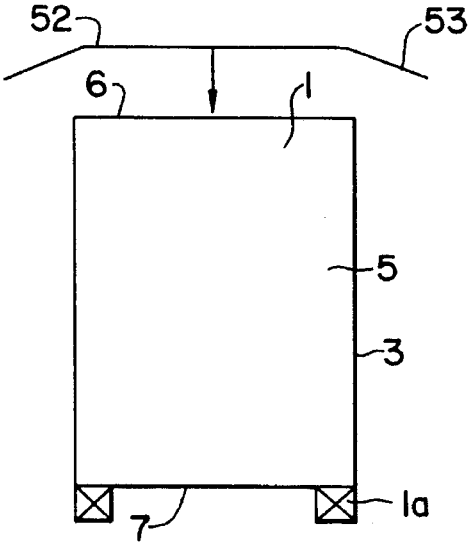
FIGS. 5A, 5B, 5C, and 5D are four diagrammatic elevation views showing successive steps in implementing another variant of the method of the invention in which the angle strips are held by being rigidly associated at each end either with the pallet or else with a top endplate or frame having a folded-down margin, that is, the frame or endplate is applied to the top horizontal face of the load with its margin in the unfolded state (FIG. 5A), the margin is folded downwardly and the angle strips are applied outside it (FIG. 5B), the angle strips are rigidly associated with the folded-down margin of the top endplate or frame and also to the pallet (FIG. 5C), and the load prepared in this way does not have an outer packaging film (FIG. 5D)
Figure 5B:
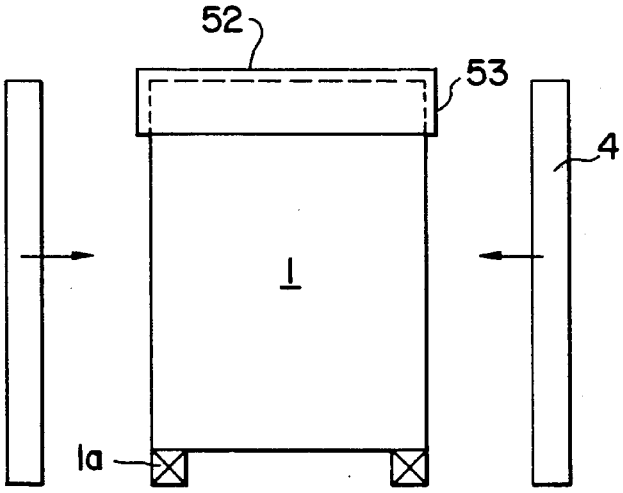
Figure 5C:
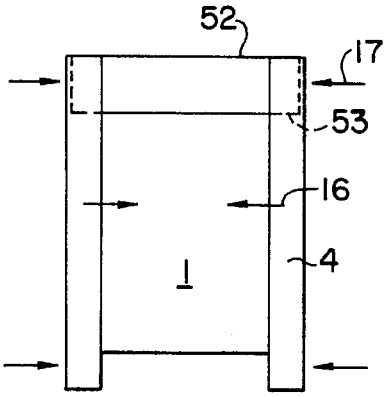
Figure 5D:
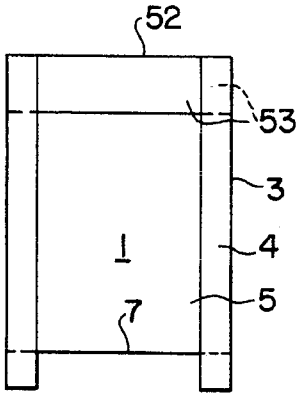
Figure 6A:
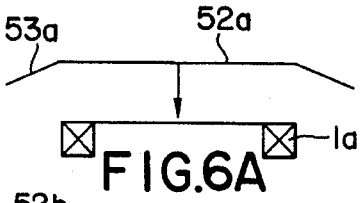
FIGS. 6A, 6B, 6C, 6D, 6E, 6F, 6G, and 6H are eight diagrammatic elevation views showing the successive steps of another variant implementation of the method of the invention in which the angle strips are retained by the folded-down margins of two endplates or frames at the top and bottom ends respectively of the load and by means of a helically wound outer packaging film (right-half view of FIG. 6G) or by means of a tube covering (left-half view of FIG. 6H), that is, a bottom endplate or frame with an unfolded margin is fed to and deposited on a pallet (FIG. 6A), the load is made up on the pallet on top of the bottom endplate or frame (FIG. 6B), a top endplate or frame having an unfolded margin is fed to and placed on the top horizontal face of the built-up load (FIG. 6C), the angle strips are put into place while the margins of the top and bottom frames or endplates remain unfolded (FIG. 6D), once the angle strips are in place and are held in place, the margins of the two endplates or frames are folded downwardly and upwardly, respectively against the load (FIG. 6E), thereby retaining the angle strips which no longer need to be held in place since they are now held by the folded-down margins (FIG. 6F)

In a second variant, the angle strip 4 is glued, welded, stapled, clipped, or otherwise connected to the load 1 or to a packaging element thereof for the purpose of holding the angle strip 4 in place. This variant is illustrated by the diagrams of FIGS. 4A, 4B, and 4C, in which connection of the angle strips is provided by means of staples 57. The packaging element of the load in question may be selected from the group comprising the pallet **1*a*, an intermediate portion, an endplate or frame 52, and a container 1 for the load per se. The angle strip 4 is glued, welded, stapled, clipped, or otherwise connected to the load 1 or to a packaging element thereof in a first zone 16 or at a distance therefrom. The second zone 17 is identical to the first zone 16 when the way in which the angle strip is applied to the load 1 ensures that it is permanently secured thereto as desired, for example, because the inside angle of the angle strip 4 includes glue or a functional equivalent that provides the desired fastening when the angle strip is pressed against the load 1 by the apparatus 14. Otherwise, a stapler or an equivalent apparatus may be incorporated into the apparatus 14. In other circumstances, the second zone 17 is distinct from the first zone 16 (as shown in FIGS. 4A to 4C). An additional film of outer packaging 2 may be subsequently installed (FIG. 4B) or not (FIG. 4C). In the case shown in FIGS. 5A to 5D, the angle strip 4 is rigidly associated, for example, by means of glue or staples, firstly at its top end to a top endplate or frame 52 whose flap 53 has previously been folded down and thus lies beneath the angle strip 4, and secondly at its bottom end, to the pallet 1***a* in the same manner, the angle strip 4 having an appropriate length. Alternatively, and similarly, it is possible to begin by installing a bottom endplate or frame 52 having flaps that are likewise folded upwardly as taught with reference to the third variant and FIGS. 6A et seq, with the angle strip being placed over the outside of said flap and being rigidly associated therewith.

Figure 6B:
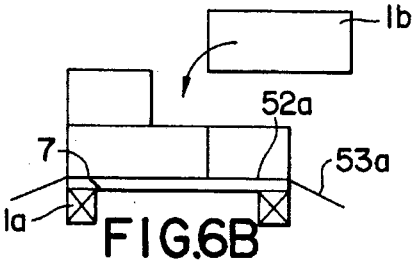
Figure 6C:
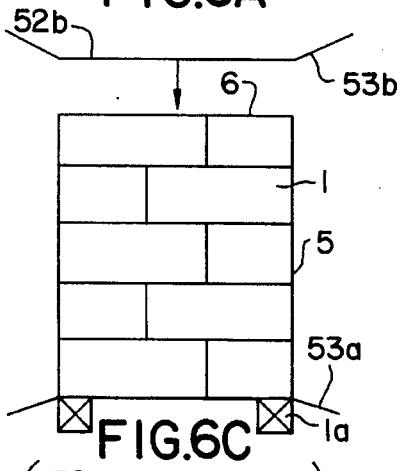
Figure 6D:
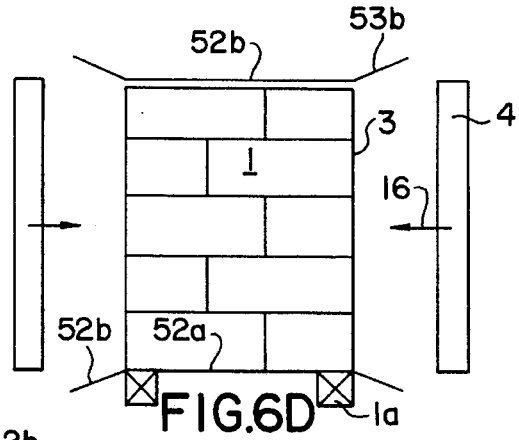
Figure 6E:
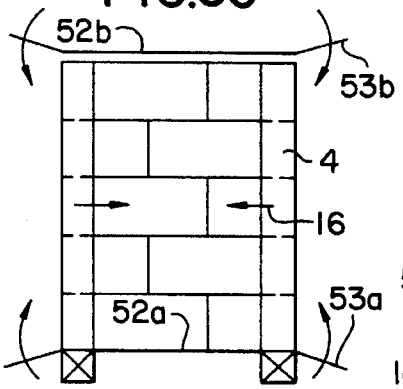
Figure 6F:
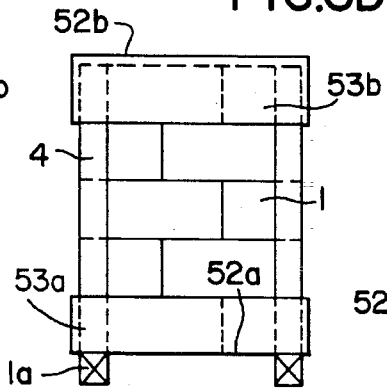
Figures 6G, 6H:
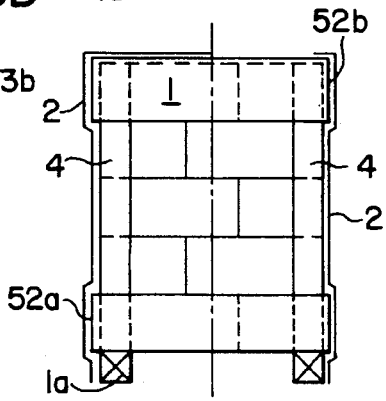

In a third variant, at least one of the ends of the angle strip 4 is clamped against the load 1 in a zone 17 that is at a distance from the zone 16 by means of an endplate or frame 52 having a margin 53 that is folded down over the angle strip 4, thereby clamping it. To this end: the angle strip 4 is placed on the edge 3 and an endplate or frame 52 having a non-folded margin 53 is placed over at least one of the end faces 6 and 7 of the load 1; thereafter, the margin 53 of the endplate or frame 52 is folded downwardly over the angle strip 4. This variant is shown more particularly in FIGS. 6A to 6G for an angle strip 4 which is held both at its top end and at its bottom end by corresponding flaps 53*a* and 53*b* of a top endplate 52*b* and of a bottom endplate 52*a*. To this end, apparatus such as 51 and 54 are implemented for each of the two endplates or frames 52*a*, 52*b*, and for each of the corresponding flaps 53*a*, 53*b*. To do this, and starting with a pallet 1*a*, for example, the bottom endplate or frame 52*a* is placed on the pallet by a feed apparatus 51, with the margin 53*a* of the endplate being left unfolded, that is, substantially coplanar therewith. Then, a palletizer forming a part of the packaging installation (not shown) feeds unit packets 1*b* (or load 1) onto the endplate or frame 52*a* (FIG. 6B) until the endplate or frame 52*a* is held captive beneath the load, with its margin or flap 53*a* still remaining unfolded. Similarly, an appropriate feed apparatus 51 (the same or another apparatus) feeds a top endplate or frame 52*b* with an unfolded margin 53*b* onto the top face 6 of the load 1 (FIG. 6C). The angle strips 4 can then be applied to the load 1 and its edges 3 with the angle strips being held in their zones 16 by the apparatus 14, while the flaps 53*a* and 53*b* remain free and unfolded (FIG. 6D). With the angle strips 4 continuing to be held in place by the apparatus 14, and with the apparatus 51 being appropriately retracted, two apparatus 54 can be implemented to fold the two flaps 53*a* and 53*b* (FIG. 6E) over the second zones 17 of the angle strips 4, thereby holding the strips 4 captive against the load 1 (FIG. 6F). The load can then be left in this situation. Alternatively, the flaps 53*a* and 53*b* can be secured by hoop strip, glue, staples, or other means (not shown). It is also possible to install an outer packaging film 2 by a winding operation (FIG. 6G) or by fitting a tube thereover (FIG. 6H) or in some other way. Naturally, the sequence described above can be subjected to various implementations seeking to achieve the same purpose. As mentioned above, when endplates or frames 52 are used, they may be made of cardboard that has been scored along fold lines for the flaps 53. Such endplates or frames are such that once the flaps 53 have been folded with a certain amount of force, they retain substantial residual folding even with small external stresses tending to move the flaps 53 apart.

As can be seen from the above, such endplates or frames 52 can suffice on their own to provide adequate temporary retention of the angle strips 4 prior to subsequent outer packaging, or even permanent retention without outer packaging, particularly when the flaps 53 are secured to one another and/or to the angle strips 4. Such endplates or frames 52 also have the advantage of enabling the angle strips 4 to be retained at one or at both ends. Thus, depending on the relative positioning of the angle strips 4 and a flap 53 (inside or outside the flap), the feed apparatus 14 or apparatus 51 for putting an endplate or frame 52 into place, or apparatus 54 for folding down the margin or flap 53 thereof can be operationally associated to follow a sequence selected from the group comprising the following sequences: the apparatus 51 for putting an endplate or frame 52 into place is initially operated, followed by the apparatus 54 for folding down the margin 53, and finally the apparatus 14 is operated so the angle strip 4 then lies on the outside of the folded-down margin 53; and the apparatus 14 and the apparatus 51 for putting an endplate or frame 52 into place are operated initially followed by the apparatus 54 for folding down the margin 53, in which case the angle strip 4 is on the inside of the folded-down margin 53.

In another aspect, the invention also relates both to the apparatus 51 for feeding and putting an endplate or frame 52 into place, and also to apparatus 54 for folding down a flap 53 of such an endplate or frame 52.

These two apparatus 51 and 54 are incorporated into a machine or installation as described above for enabling angle strips to be put into place.

In a first variant, these two apparatus 51 and 54 are distinct and independent from each other. In a second embodiment, these two apparatus 51 and 54 are incorporated into a common assembly.

Figure 16:
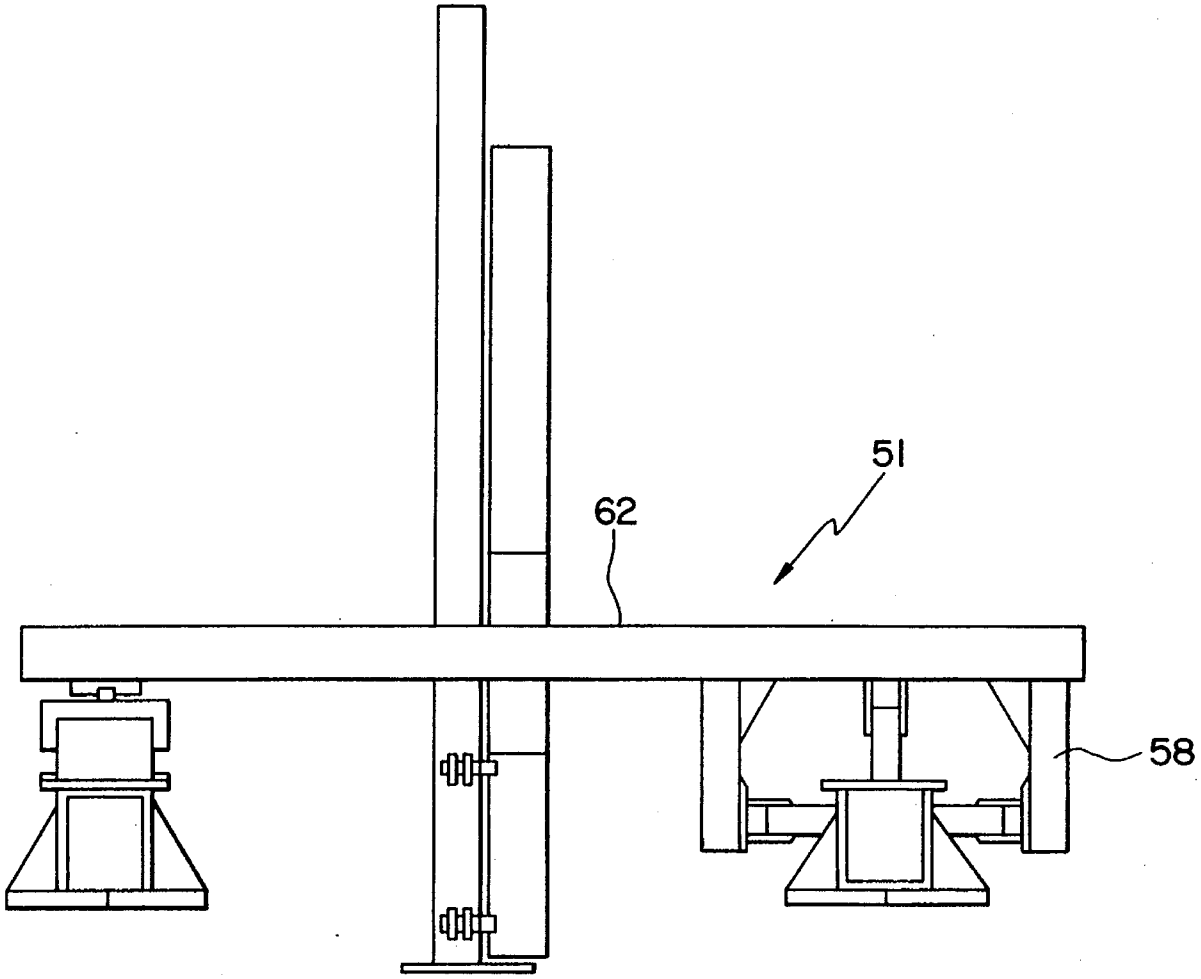
FIG. 16 is a fragmentary side view of the apparatus of FIG. 15, showing its moving portion.

The characteristics of the apparatus 51 for feeding and putting into place endplates or frames are described below with reference more particularly to FIGS. 15 to 17.

Such feeding and depositing apparatus 51 comprises:

a chassis 58;

at least one magazine 59 for endplates or frames 52;

grasping means 60 for grasping an endplate or frame 52, which grasping means is either in an active state or in an inactive state;

support means 61 for supporting the grasping means 60;

drive means 62 for driving the support means 61 and thus the grasping means 60 between a grasping position in which the grasping means is situated at or in the vicinity of the outlet opening 63 from the magazine 59, and a deposition position in which the grasping means 60 is situated at or in the vicinity of the zone where the endplate or frame 52 is to be placed on the load 1; and control means for coordinating the operation of the grasping means 60 and of the drive means 62.

The chassis 58 may be incorporated to a greater or lesser extent in the chassis of the packaging machine that also deposits the angle strips.

The magazine 59 is preferably organized to enable endplates or frames 52 to be stacked in such a manner as to be placed horizontally with its outlet opening 63 being at the top of the stack. The outlet opening 63 can also be used as an opening for refilling the magazine with endplates or frames 52.

Figure 17:
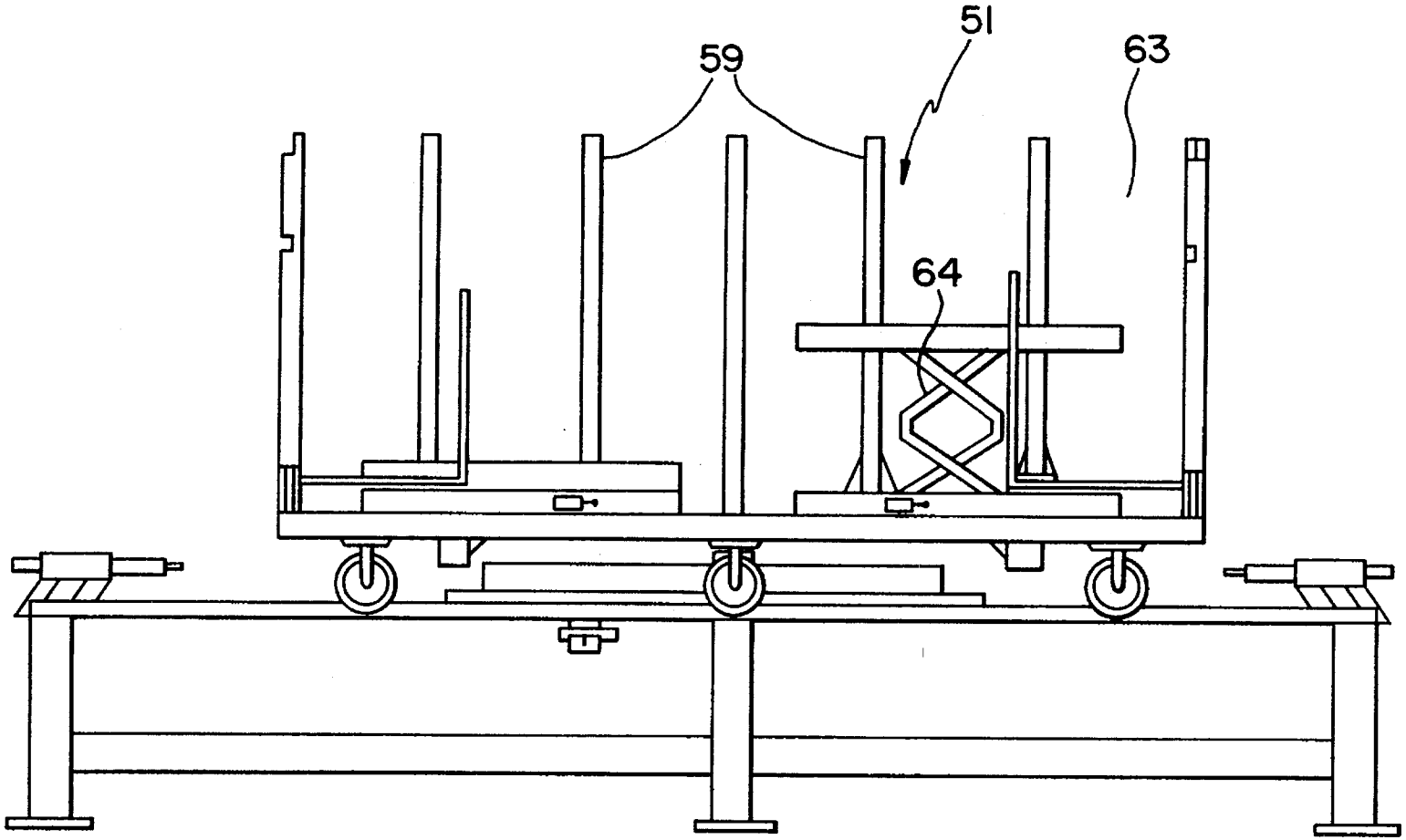
FIG. 17 is a fragmentary side view of the apparatus of FIG. 15 showing a variant having a plurality of magazines and constant-level grasping apparatus.

In the variant embodiment shown in FIG. 17, provision is made for two magazines 59 to be placed side by side on a moving chassis together with means such as an actuator that serves to displace the magazines 59 relative to the support means 61.

In the non-limiting embodiment shown in the drawings, the drive means 62 is arranged to slide both vertically and horizontally, respectively for the operations of grasping and depositing, and for the operation of passing from one position to another.

Under such circumstances, and starting from a waiting position in which the grasping means 60 is situated vertically above but at a distance from an endplate or frame 52 at the outlet opening 63, the following successive operations are performed:

The grasping means 60 is brought into contact with an endplate or frame 52 by sliding vertically downwards. To this end, the support means 61 in the form of a support plate may include a contact switch or detector 69 which prevents the downwards sliding movement when the grasping means is capable of engaging an endplate or frame 52.

In this situation where the grasping means 60 is at a distance from the load and is situated in a somewhat lowered position, the grasping means is initially caused to pass from its inactive state to its active state. In the inactive state, the grasping means cannot take hold of and retain an endplate or frame 52, whereas, in contrast, when in the active state it can. Consequently, the grasping means 60 is switched from the inactive state to the active state in order to associate an endplate or frame 52 to the grasping means 60 carried by the support means 61 which includes a support plate 70.

The drive means 62 then causes the grasping means 60 to move vertically upwards while it is maintained in the active state. Thereafter, the drive means 62 causes the grasping means 60 to be displaced from its position at a distance from the load to its deposition position, in particular bringing the endplate or frame 52 so that it is vertically above the location where it is to be placed on the load or on a packaging element thereof (the horizontal top face of the load or the pallet 1*a*).

The drive means 62 can then be used to cause the grasping means 60 to move vertically downwards while the grasping means 60 is still retained in the active state so as to continue holding the endplate or frame 52.

This movement continues until the grasping means 60 comes to rest, with the endplate or frame 52 suitably close to its required position on the load.

In this situation, the grasping means 60 can be switched from the active state to the inactive state. As a result the endplate or frame 52 is released from the grasping means 60 and it falls vertically under its own weight to the desired position.

Thereafter, the feed device 51 can return to its initial state by sliding vertically upwards and then by sliding to its distant position, with the grasping means 60 being left in its inactive state.

It will naturally be understood that other operating sequences could be devised to achieve a similar effect.

Insofar as the chassis 58 is in part common with the packaging machine as described above, the chassis 58 does not interfere with the moving members of the machine. To this end, the chassis 58 is disposed, in particular, above and outside said members. Under such circumstances, the magazines 59 may be placed horizontally beside the packaging machine, as can clearly be seen in FIG. 15.

In a variant embodiment, the chassis 58 includes pillars 71 or extensions of pillars of the machine situated generally towards the outside thereof, and longitudinal members 72 disposed horizontally at the tops thereof. These members 72 constitute a guide path (or track) for a carriage 73. The carriage is mounted to slide between two end portions of the longitudinal member 72 corresponding to the two different positions of the grasping means 60. To this end, drive means is provided such as an actuator, a motor and gear box unit, a motor-driven endless chain, or the like.

The carriage 73 itself includes vertical sliding means 74 whose bottom end 75 supports the support plate 70 with the grasping means 60 being disposed on the bottom face thereof, optionally together with a contactor or sensor 69.

The grasping means 60 preferably comprise suction cups. In order to ensure that the endplate or frame 52 grasped by such suction cups 60 is held securely, it is common practice to provide a plurality of suction cups 60 that are uniformly disposed on the underside of the support plate 70.

In order to ensure that a machine including the feed apparatus 51 constitutes a compact assembly, the magazine 59 is preferably situated in the immediate vicinity of the means for putting the outer packaging film into place.

Regardless of whether the feed apparatus 51 has one or more magazines 59, such a magazine may be provided (see FIG. 17) with a device 64 for ensuring that regardless of the extent to which the magazine is filled, endplates or frames are grasped therefrom at a constant height. The device 64 may be constituted by a lifting table, for example. As a result, regardless of the extent to which the magazine is filled, there is always an endplate or frame 52 in its outlet opening 63, such that the sliding stroke of the displacement members 66 for grasping such an endplate remains substantially constant.

It will be understood that if the apparatus 51 as described above is intended to place an endplate or frame 52 on the pallet 1*a*, then its vertical downwards stroke in the deposition position is greater than for apparatus intended merely to deposit the endplate or frame 52 on the top horizontal face 6 of the load.

In addition, when the endplate or frame 52 is designed to be interposed between a pallet 1*a* and unit loads 1*b* making up a load (FIG. 6B), the feed apparatus 51 is functionally combined with a palletizer.

Apparatus 54 is described below more particularly with reference to FIGS. 18 to 21.

In general, such apparatus 54 comprises:

a chassis 65;

at least one flap-displacement member 66 carried by the chassis 65 to move between an inactive position in which the flap 53 can extend substantially coplanar with its endplate or frame 52, and an active position in which the flap 52 extends substantially orthogonally to the endplate or frame 52; and drive means 67 for driving the moving member 66 between said two positions.

Figure 18:
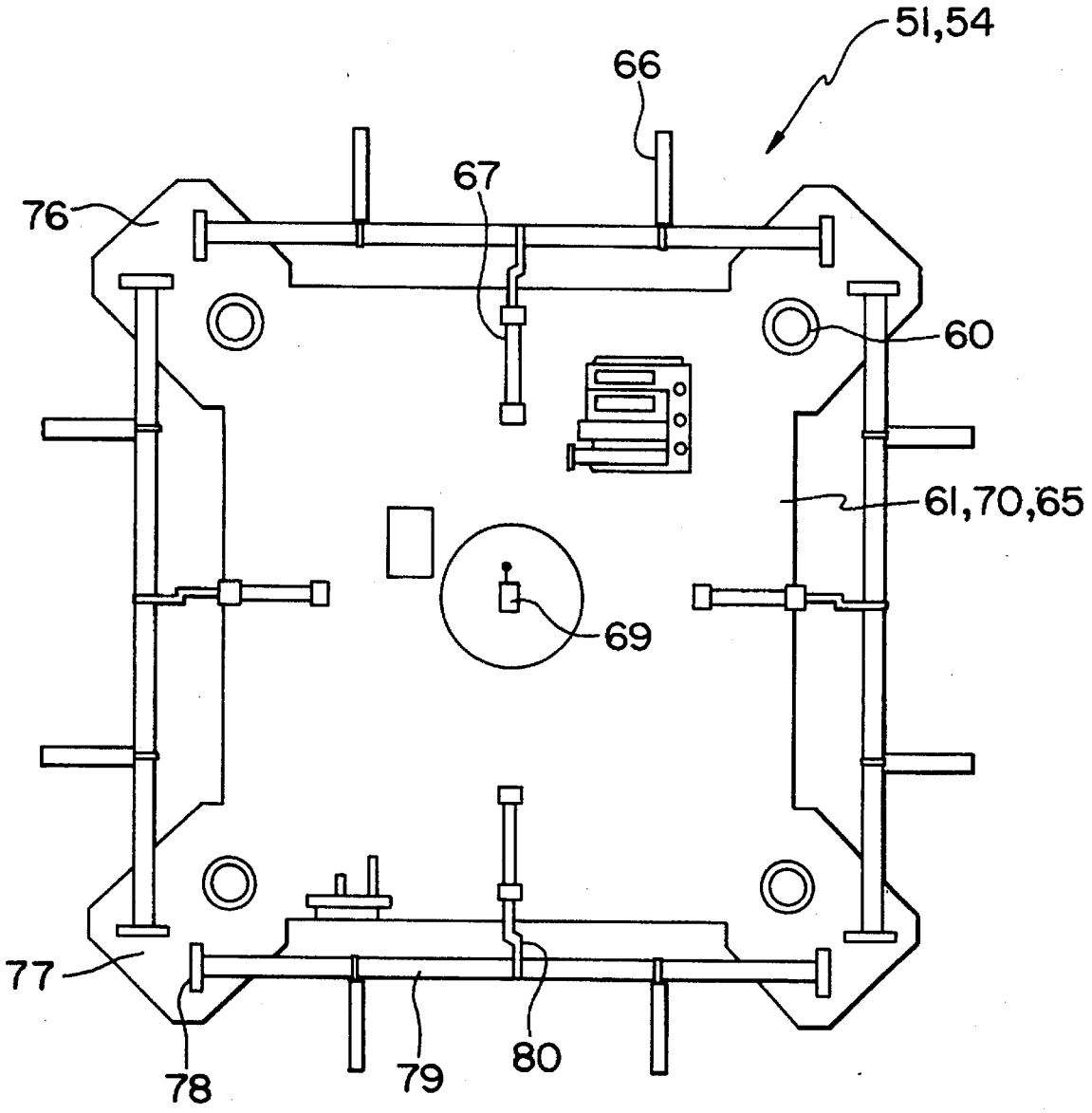
FIG. 18 is a horizontal plan view of a possible variant of the apparatus for folding down the margin of the endplate or frame, and more particularly is applicable to a top endplate or frame.
Figure 19:
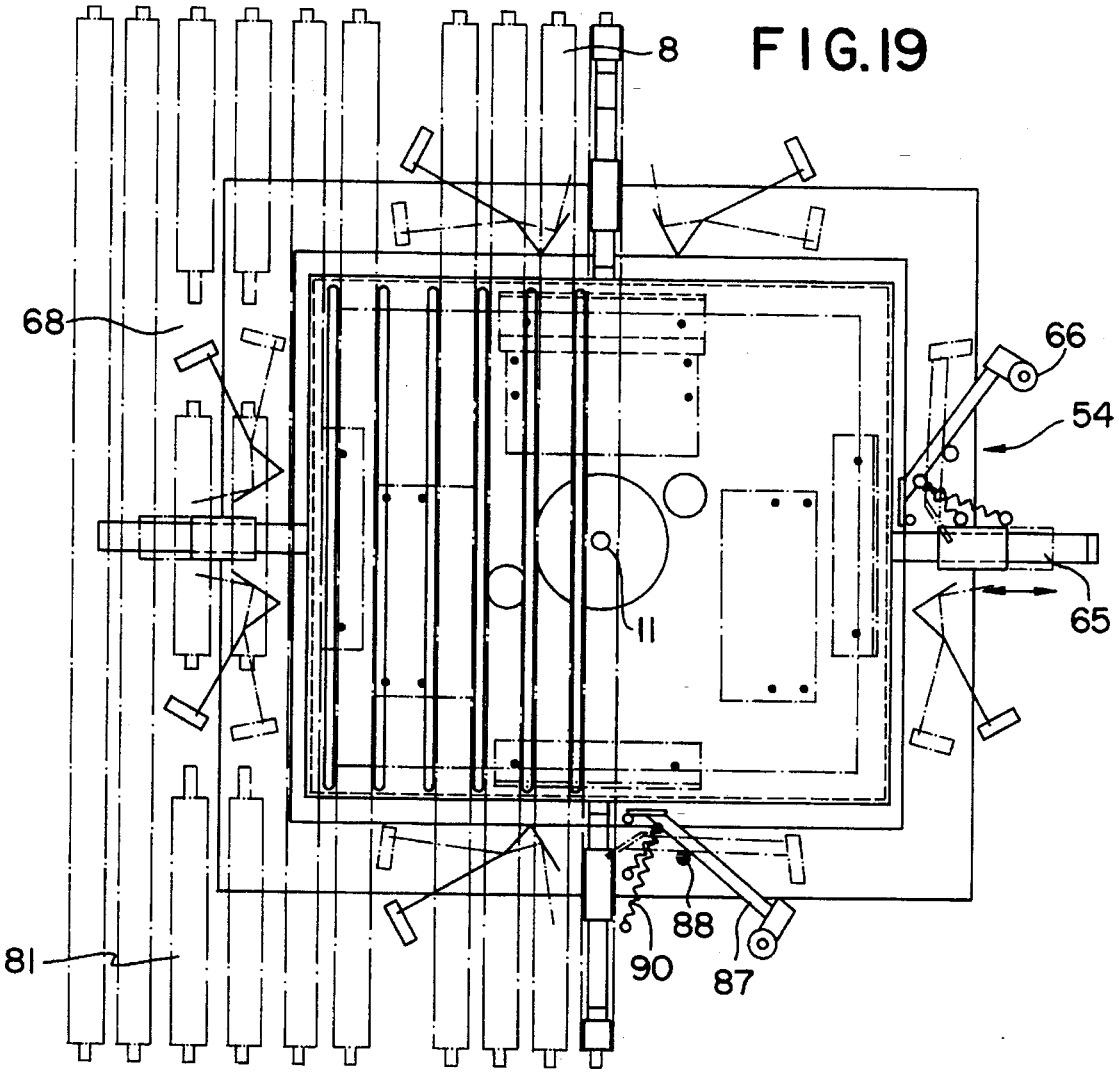
FIG. 19 is a diagrammatic plan view of another possible variant of apparatus for folding down the margin of an endplate or frame, and more particularly, is applicable to a bottom endplate or frame.
Figure 20:
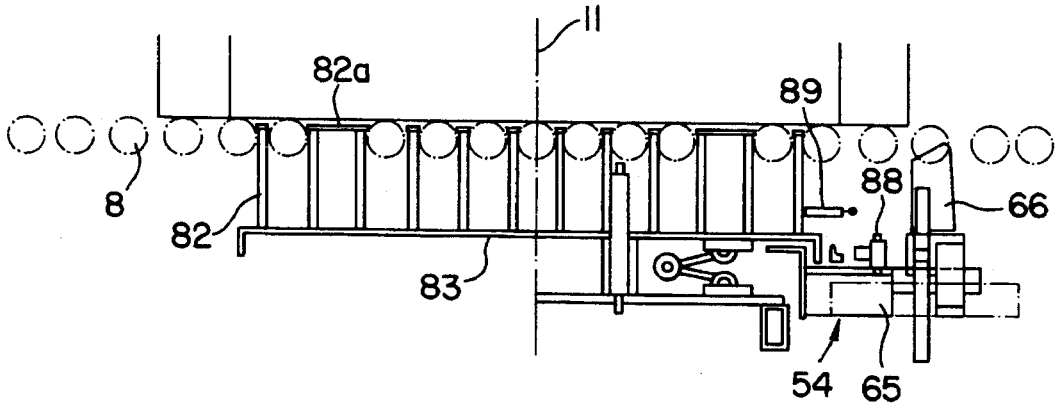
FIG. 20 is a side view of the apparatus of FIG. 19.

Such apparatus 54 is shown in FIG. 18 for the case where it is incorporated into feed and deposition apparatus 51 as described above. Under such circumstances, the chassis 65 is incorporated into the support means 61 which is generally in the form of a support plate 70. Under such circumstances, the displacement member(s) is/are to be found at the periphery of said support plate 70, with the drive means 66 likewise being carried by the support plate 65, 70. When the two apparatus 51 and 54 are structurally associated with each other as described above, the above-mentioned control means serves to coordinate the movements of the member 66 with the grasping means 60.

In the embodiment shown in FIG. 18, the member 66 is in the form of a finger pivotally mounted on the support plate 65, 70 at its periphery 76. To this end, the support plate 65, 70, includes projecting corners 77 supporting bearings 78 for shafts 79 on which the fingers 66 are secured. The drive means 67 may comprise an actuator carried by the support plate 65, 70 and hinged by means of a crank 80 to the shaft 79. The active and inactive positions are separated from each other by one-fourth of a turn. In the inactive position, the fingers 66 are substantially coplanar with the support plate 65, 70, pointing outwardly therefrom. In the active position, the members 66 are substantially orthogonal to the support plate 65, 70 pointing towards the grasping means or towards the face of the support plate that supports the grasping means 60.

Like the grasping means 60, provision is generally made for a plurality of displacement members 66, for example, two fingers on each of the shafts, with each shaft running along a respective side of the support plate 65, 70.

With reference now to the operating sequence of the feeder apparatus 51 as described above, the member 66 is in an inactive position during the stage when the endplate or frame 52 is grasped. In general, it is switched from the inactive position to the active position only after the endplate or frame 52 has already been deposited on the load 1.

The two apparatus 51 and 54 may be incorporated with each other and also with an outer packaging machine of the turntable type. Under such circumstances, the apparatus 51 and 54 can be mounted to pivot freely about the axle 48 of the outer packaging machine, which axle coincides with the axis 11 of the turntable 8. As already mentioned, the axis 48 is carried by the brackets 49 which is slidably mounted on the column 50 of the outer packaging machine.

In a possible variant embodiment, when the apparatus 54 is designed to fold the flaps of an endplate or frame 52 placed on a pallet 1*a*, the apparatus 54 is incorporated in a support plate 8 of the outer packaging machine and is therefore separate from the apparatus 51. In order to allow the member 66 to move, the support plate 8 is provided with a through opening 68. In the embodiment shown in the drawings, provision is made for a plurality of displacement members 66 in positions that are close to a position located vertically beneath the load 1.

Figure 21:
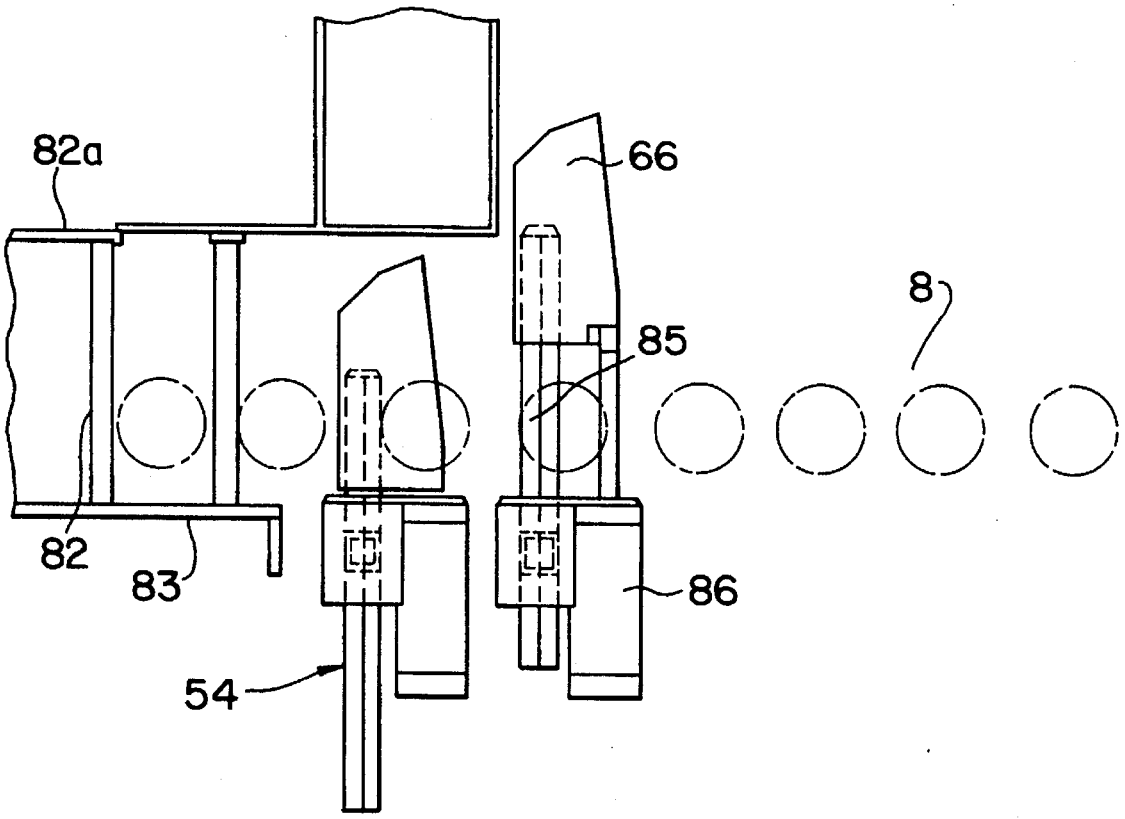
FIG. 21 is a view similar to FIG. 20, showing how the apparatus operates.

The support plate 8 is a plate having rollers 81. These rollers 81 include the gaps required for defining the passages 68. In addition, the support plate includes an elevator grid 82 having longitudinally extending members suitable for extending between the rollers 81 and carried by an underlying plate 83. Drive members for vertical sliding motion move the plate 83 and its grid 82 so that the top support surface 82*a* of the grid can be moved between a retracted bottom position (FIG. 20) and an active top position (FIG. 21). In the retracted position, the load rests on the rollers 81 whereas in the active position, the load rests on the support surface 82*a* of the grid 82.

In the embodiment shown, the displacement members 66 are in the form of flat fingers or the equivalent that are mounted to slide vertically, and to this end they are associated with vertical sliding guidance means 85 and with vertical sliding drive means 86 such as an actuator. These means 85 and 86 are carried and upwardly guided in such a manner that the fingers 66 are also directed upwardly, at the end of an arm 87 which is hinged in the middle about a vertical axis 88 carried by the chassis. An actuator 89 is hinged firstly to the chassis and secondly to the arm 87 to cause it to pivot about the axis 88. A return spring 90 may also be provided to return the arm 87 and thus the fingers 66 to a retracted situation allowing a flap 53 to remain unfolded.

In the above-described variant, the drive means 67 thus include drive means 86 and the actuator 89. The arm 87, the axis 88, the actuator 89, and the spring 90 are located together beneath the rollers 81.

Obviously, many modifications and variations of the present invention are possible in light of the above teachings. It is therefore to be understood that within the scope of the appended claims, the present invention may be practiced otherwise than as specifically described herein.

We claim:

1. A method of packaging a load that is generally prismatic in shape, has a plurality of faces, and has at least one substantially vertical edge on which at least one rigid protective angle strip is initially placed and then rigidly and permanently secured, comprising the steps of:

providing a magazine for holding a plurality of protective angle strips to be placed upon substantially vertical edge portions of loads;

providing an apparatus for grasping, displacing, depositing, and holding a protective angle strip upon one of said at least one substantially vertical edges of said load and locating said apparatus between said magazine and an edge of said load to be fitted with an angle strip;

actuating said apparatus so as to move said protective angle strip from said magazine to said edge of said load without any linear displacement therebetween and solely through pivotal movement therebetween wherein said angle strip is maintained substantially parallel to said vertical edge of said load during said pivotal movement;

depositing said protective angle strip onto said edge of said load;

temporarily holding said angle strip in at least a first zone thereof by said apparatus and surrounding said faces of said load with at least one wrapping strip applied to said load and located on a second zone different from said first zone so that said wrapping strip secures said angle strip to said load; and once said angle strip has been secured to said load by said at least one wrapping strip, disengaging said apparatus from said angle strip.

2. A method according to claim 1, wherein a wide wrapping strip is used suitable for substantially covering said faces of the load and distributing bearing forces over a wide area, whereby said wide wrapping strip distributes said bearing forces against said angle strip.

3. A method according to claim 2, wherein the wrapping strip is used to perform winding about said load, and said winding begins in said second zone so as to enable said angle strip to be secured, and then once the apparatus has been disengaged, winding of the load and of said angle strip is continued.

4. A method according to claim 1, wherein the angle strip is glued, welded, stapled, clipped, or bonded to a portion of said load for the purpose of securing said angle strip.

5. A method according to claim 4, wherein said load comprises packaging elements, said packaging elements comprising at least one of a pallet, an intermediate plate, an end plate or frame, or a container of the load, said angle strip rigidly secured to at least one of said packaging elements.

6. A method according to claim 4, wherein the angle strip is glued, welded, stapled, clipped, or bonded to the load in said first zone.

7. A method according to claim 1, including clamping said angle strip at at least one of said opposite ends to the load in a zone that is at a distance from said first zone by providing an end plate or frame having a margin folded down over said angle strip, thereby clamping said strip, said method further including applying said end plate or frame having a margin that is not folded down to at least one of the end faces of the load; and positively folding said margin of said end plate or frame down onto said angle strip.

8. A method according to claim 7, wherein said angle strip is clamped onto the load by two respective end plates or frames.

9. A method according to claim 1, wherein after said angle strips are secured rigidly said angle strips on said load are at least partially covered with wrapping film applied to the load.

10. A method according to claim 9, wherein a stretch wrapping film is used.

11. A method according to claim 9, wherein a stretch wrapping film is used which is prestretched prior to being deposited and applied to the load.

12. A method according to claim 1, wherein a plurality of protective angle strips are placed on a plurality of edges of the load substantially simultaneously using a plurality of synchronously operating distinct apparatuses for grasping, displacing, depositing, and holding angle strips.

13. A method according to claim 1, wherein a protective angle strip is used which has a general longitudinal direction, and while said protective angle strip is being displaced from the magazine to the corresponding edge of the load, said grasping and holding apparatus is separately pivoting said longitudinal direction of said angle strip through about 180°.

14. A method according to claim 1, wherein said load includes a winding axis, said load and the angle strip are covered by winding with a strip of packaging film taken from a reel of film having an axis, wherein said winding step comprises: associating an initial free end portion of said strip of film with the load or with said angle strip, relatively displacing the load and the reel of film so as to cause unwinding of the reel of film and winding of said film about said axis of the load; cutting said strip of film transversely once winding has been completed creating a free end portion; and associating said free end portion with the film already wound or with the load, or with said angle strip.

15. A method according to claim 1, wherein said angle strips are preformed to conform to said edge of said load and are grasped, displaced, deposited, and held substantially in said preformed state.

16. A method according to claim 1, wherein said angle strips are initially comprised of two flat sides and two longitudinal edges, the strips are grasped and placed on the corresponding edge of the load where said angle strip is deformed to form an angle on the edge of said load conforming to said edge of said load.

17. A method according to claim 16, wherein in order to impart said angle to an angle strip, said angle strip is grasped at or adjacent to said longitudinal edges, and said method further comprises pressing said angle strip at a portion between said longitudinal edges against a projecting edge of the load.

18. Apparatus for grasping, displacing, depositing, and holding a protective angle strip, having an included angle and a corresponding outside angle, upon an edge portion of a load, comprising:

a chassis;

a magazine, having a longitudinal outlet opening, in which a plurality of angle strips are stored with said outside angles directed towards said outlet opening of said magazine, and longitudinal edges of said angle strips being disposed parallel to longitudinal edges of said outlet opening such that said angle strips are disposed substantially parallel to said edge of said load;

a support arm having a first end portion thereof pivotably mounted upon said chassis about an axis that is substantially parallel to said longitudinal edges of said angle strips and said outlet opening of said magazine so as to be movable between a grasping position adjacent to said magazine and a depositing and holding position adjacent to said edge portion of said load;

grasping and holding means pivotably mounted upon a second end portion of said support arm about an axis parallel to said axis mounting said support arm upon said chassis and disposable in either an active state for grasping and holding an angle strip by said outside angle or an inactive state for releasing said angle strip; and drive means for pivoting said support arm between said grasping position and said depositing and holding position and for pivoting said grasping and holding means so as to move said protective angle strip, when grasped by said grasping and holding means disposed in said active state, from said magazine to said edge of said load without any linear displacement therebetween and solely through pivotal movement therebetween of said support arm and said grasping and holding means and wherein said angle strip is maintained substantially parallel to said edge of said load during said pivotal movement.

19. Apparatus according to claim 18, wherein the grasping and holding means comprise at least two suction cups which are situated in the vicinity of the longitudinal edges of the outlet opening of the magazine when the support arm is in its grasping position.

20. Apparatus according to claim 18, wherein the grasping and holding means include at least one shaping member which is generally angle-shaped.

21. Apparatus according to claim 18, wherein the grasping and holding means comprise a support bar extending substantially parallel to the general longitudinal direction of the outlet opening of the magazine and having a plurality of suction cup assembly and shaping member pairs disposed along its length.

22. Apparatus according to claim 21, wherein the support bar is mounted to rotate relative to the support arm.

23. The apparatus as set forth in claim 18, further comprising:

means for constantly bringing an angle strip into said outlet opening of said magazine.

24. Apparatus according to claim 23, wherein the said first means for constantly bringing an angle strip into said outlet opening of said magazine comprise a rear support plate for the angle strips, said rear support plate slidably movable in a transverse direction and urged towards said outlet opening by a support conveyor for the angle strips in the magazine.

25. The apparatus as set forth in claim 18, further comprising:

specific control means for controlling said grasping and holding means and enabling said grasping and holding means to switch between said two active and inactive states as well as to be temporarily held within either one of said two states; and overall control means for coordinating said drive means and said specific control means.

26. Apparatus according to claim 25, wherein said grasping and holding means are displaceably mounted on the support arm to move between two end positions, said end positions including a grasping position and a depositing position; said apparatus further including a second drive means for displacing said grasping and holding means between said end positions and to lock said grasping and holding means therein; said overall control means serving to coordinate said grasping and holding means with said first drive means and with said specific control means.

27. Apparatus according to claim 26, wherein said grasping and holding means are pivotally mounted on the support arm to pivot about a hinge axis substantially parallel to the general longitudinal direction of the outlet opening of the magazine; said second drive means adapted to pivot said grasping and holding means between two end positions that are generally spaced apart angularly about 180°, said second drive means adapted to keep said angle strips substantially parallel to said hinge axis.

28. Apparatus according to claim 25, wherein said chassis is adapted to be displacable and lockable in a plurality of positions in order to adjust said apparatus as a function of the dimensions of the load, said chassis including moving support means comprising wheels and drive means, including actuators controlled by said overall control means of the apparatus.

29. Apparatus according to claim 28, wherein the chassis is mounted to be slidably displaceable in a direction substantially orthogonal to the longitudinal direction of the outlet opening of the magazine.

30. Apparatus according to claim 25, wherein the grasping and holding means are displaceably mounted on the support arm to move along a stroke that is adjustable in order to adjust the apparatus as a function of the dimensions of the load concerned, under the control of the overall control means of the apparatus.

31. Apparatus according to claim 25, wherein the drive means are arranged to be adjustable with respect to the stroke of the support arm between its two end positions controlled by said overall control means of the apparatus for the purpose of adjusting the apparatus as a function of the dimensions of the load.

32. A packaging machine for mounting at least one protective angle strip upon a vertical edge of a load, wherein said angle strip comprises two elongated portions having an included angle therebetween forming an inside corner, comprising:

a magazine for housing a plurality of said protective angle strips with said elongated portions thereof disposed parallel to said vertical edge of said load;

means, pivotably mounted about an axis disposed parallel to said vertical edge of said load, for grasping and holding an angle strip and for pivotably moving said angle strip through a predetermined angle from said magazine to said load without any linear displacement therebetween and solely through pivotal movement therebetween while said elongated portions of said angle strip are maintained parallel to said pivot axis and said vertical edge of said load such that said inside corner of said angle strip is placed directly at said vertical edge of said load;

means for feeding and depositing an end plate onto an end of said load, and for folding a marginal portion of said end plate so as to thereby clamp said angle strip onto said load; and means for actuating said grasping and holding means, and said feeding, depositing, and folding means in a coordinate manner.

33. Apparatus for mounting at least one protective angle strip upon a substantially vertical edge of a load, wherein said angle strip comprises two elongated portions having an included angle therebetween forming an inside corner, comprising:

a chassis;

a magazine for housing a plurality of said protective angle strips with said elongated portions thereof disposed parallel to said vertical edge of said load;

grasping and holding means, pivotably mounted about an axis disposed parallel to said vertical edge of said load, for grasping and holding a protective angle strip and for pivotably moving said angle strip through a predetermined angle from said magazine to said load without any linear displacement therebetween and solely through pivotal movement therebetween while said elongated portions of said angle strip are maintained parallel to said pivot axis and said vertical edge of said load such that said inside corner of said angle strip is placed directly at said vertical edge of said load;

at least one flap displacement member carried by said chassis in a movable manner between an inactive position in which a flap of an end plate, to be deposited upon an end of said load, can be disposed substantially coplanar with said end plate, and an active position in which said flap is disposed substantially orthogonally with respect to said end plate so as to secure said angle strip upon said load; and drive means for driving said flap displacement member between said two active and inactive positions.

34. Apparatus according to claim 33, wherein said apparatus includes a means for feeding and depositing end plates or frames, said chassis including support means comprising a plate having placed at the periphery thereof at least one of said flap displacement members, said drive means being carried by the chassis plate and further including control means for ensuring coordinated movement of said flap displacement members and said grasping and holding means.

35. Apparatus according to claim 34, wherein said flap displacement member is in the form of a finger pivotally mounted on the chassis plate, said finger being, when in its inactive position, substantially coplanar with the chassis plate and pointing outwards, and when in an active position, being substantially orthogonal to the chassis plate and being directed towards said grasping and holding means.

36. Apparatus for placing corner protectors onto loads having a plurality of vertical sides meeting generally at right angles, each corner protector having two elongate panels meeting generally at a right angle so as to define an outside corner and an inside corner, comprising:

a magazine adapted to hold a supply of corner protectors wherein said elongate panels of said corner protectors are disposed parallel to said vertical sides of said loads and to vertical corners of said loads defined by said vertical sides of said loads meeting generally at said right angles;

means, pivotably mounted about an axis disposed parallel to said vertical sides and said vertical corners of said loads, for removing one of said corner protectors from said magazine and for pivotably transferring said one of said corner protectors through a predetermined angle from said magazine to said load without any linear displacement therebetween and solely through pivotal movement therebetween while said elongate panels of said corner protector are maintained parallel to said pivot axis and said vertical corner of said load such that said inside corner of said one of said corner protectors is placed directly at one of said vertical corners of said load; and means for wrapping outer packaging film around said load and said corner protector for securing said corner protector upon said load.

37. The apparatus of claim 36, further comprising means for coordinating said transferring means and said wrapping means.

38. The apparatus of claim 36, wherein said magazine has an outlet opening in a general longitudinal direction, said outlet opening generally parallel to said vertical sides and said angle strips are stored in said magazine having said outside corners directed toward said outlet openings.

39. The apparatus of claim 36, wherein said means for transferring includes means for pivoting said corner protector through generally 225° between said magazine and at least one said vertical side.

40. A packaging machine for rigidly and permanently securing at least one protective angle strip upon a substantially vertical edge of a load, comprising:

a magazine for housing an angle strip wherein said angle strip comprises two longitudinal portions having an included angle therebetween forming an inside corner;

means, pivotably mounted about an axis disposed parallel to said vertical edge of said load, for grasping and holding said angle strip and for pivotably moving said angle strip through a predetermined angle from said magazine to said load without any linear displacement therebetween and solely through pivotal movement therebetween while said longitudinal portions of said angle strip are maintained parallel to said pivot axis and said vertical edge of said load such that said inside corner of said angle strip is placed directly at said substantially vertical edge of said load;

means for wrapping said load with outer packaging film, while said grasping and holding means holds said angle strip in contact with said vertical edge of said load, so as to secure said angle strip to said load; and coordinating means for actuating said grasping and holding means, and said wrapping means, in a coordinated manner.

* * * * *